US008740660B2

(12) United States Patent
Wingate et al.

(10) Patent No.: US 8,740,660 B2
(45) Date of Patent: Jun. 3, 2014

(54) POD DRIVE INSTALLATION AND HULL CONFIGURATION FOR A MARINE VESSEL

(75) Inventors: Wayne Wingate, Bothell, WA (US); Richard Sparks, Margate, FL (US)

(73) Assignee: ZF Friedrichshafen AG, Friedrichshafen (DE)

( * ) Notice: Subject to any disclaimer, the term of this patent is extended or adjusted under 35 U.S.C. 154(b) by 323 days.

(21) Appl. No.: 13/378,486

(22) PCT Filed: Jun. 24, 2010

(86) PCT No.: PCT/US2010/039806

§ 371 (c)(1), (2), (4) Date: Dec. 15, 2011

(87) PCT Pub. No.: WO2010/151659

PCT Pub. Date: Dec. 29, 2010

(65) Prior Publication Data

US 2012/0100764 A1 Apr. 26, 2012

Related U.S. Application Data

(60) Provisional application No. 61/220,071, filed on Jun. 24, 2009, provisional application No. 61/236,381, filed on Aug. 24, 2009.

(51) Int. Cl.

| | |
|---|---|
| ***B63H 5/20*** | (2006.01) |
| ***B63H 5/125*** | (2006.01) |
| ***B63H 20/08*** | (2006.01) |
| *B63B 1/00* | (2006.01) |

(52) U.S. Cl.

USPC ..... 440/53; 440/61 S; 114/61.32

(58) Field of Classification Search

CPC ..... B63H 20/00; B63H 5/07; B63H 5/125; B63H 5/1252; B63H 5/16; B63B 1/042

USPC ..... 440/49, 53, 54, 57, 58, 59, 61 S, 66–72; 114/271, 288, 290, 56.1, 27, 61.2, 114/61.32, 144 R, 144 B

See application file for complete search history.

(56) References Cited

U.S. PATENT DOCUMENTS

| | | | |
|---|---|---|---|
| 3,508,512 | A | 4/1970 | Desrayaud et al. |
| 3,844,242 | A | 10/1974 | Sernatinger et al. |

(Continued)

FOREIGN PATENT DOCUMENTS

| | | | |
|---|---|---|---|
| EP | 1 777 154 | A2 | 4/2007 |
| WO | 96/00682 | A1 | 1/1996 |
| WO | 96/00683 | A1 | 1/1996 |

OTHER PUBLICATIONS

Dale Enns, Control Allocation Approaches, American Institute of Aeronautics and Astronautics, Inc., 1998, pp. 98-108.

*Primary Examiner* — Daniel V Venne

(74) *Attorney, Agent, or Firm* — Davis & Bujold, PLLC; Michael J. Bujold

(57) ABSTRACT

A pod drive installation and hull configurations for mounting a pod drive unit to a hull which includes a horizontally disposed pod drive platform for supporting a rotational pod drive mount for mounting the pod drive unit with a vertically oriented steering axis. The pod drive platform is mounted to the hull, outward of the keel of the vessel, such that the pod drive platform intersects a plane defined by a bottom hull surface tilted from the horizontal along a contour of intersection, between an outboard boundary of the pod drive platform and an inboard boundary of the pod drive platform, and is connected to the bottom hull surface by at least one of an outboard sidewall and an inboard sidewall.

13 Claims, 28 Drawing Sheets

(56) References Cited

U.S. PATENT DOCUMENTS

| | | | | |
|---|---|---|---|---|
| 4,074,648 | A | 2/1978 | Reid et al. | |
| 4,089,287 | A | 5/1978 | Kranert et al. | |
| 4,220,111 | A | 9/1980 | Krautkremer et al. | |
| 4,519,335 | A | 5/1985 | Krautkremer et al. | |
| 4,626,757 | A | 12/1986 | Granchelli | |
| 4,691,659 | A | 9/1987 | Ito et al. | |
| 4,815,996 | A * | 3/1989 | Carr | 440/75 |
| 4,915,048 | A | 4/1990 | Stanford | |
| 5,523,951 | A | 6/1996 | Kriesgman et al. | |
| 5,755,605 | A * | 5/1998 | Asberg | 440/75 |
| 5,983,145 | A | 11/1999 | Becker | |
| 6,032,087 | A | 2/2000 | Yamamoto | |
| 6,357,375 | B1 | 3/2002 | Ellis | |
| 6,386,930 | B2 | 5/2002 | Moffet | |
| 6,401,644 | B2 | 6/2002 | Fadeley et al. | |
| 6,447,349 | B1 | 9/2002 | Fadeley et al. | |
| 6,450,112 | B1 | 9/2002 | Deghuee | |
| 6,453,835 | B2 | 9/2002 | Fadeley et al. | |
| 6,511,354 | B1 | 1/2003 | Gonring et al. | |
| 6,865,996 | B2 | 3/2005 | Borrett | |
| 6,942,531 | B1 | 9/2005 | Fell et al. | |
| 6,994,046 | B2 | 2/2006 | Kaji et al. | |
| 7,006,905 | B2 | 2/2006 | Hamamatsu et al. | |
| RE39,032 | E | 3/2006 | Gonring et al. | |
| 7,033,234 | B2 * | 4/2006 | Arvidsson et al. | 440/1 |
| 7,037,150 | B2 | 5/2006 | Morvillo | |
| 7,052,338 | B2 | 5/2006 | Morvillo | |
| 7,131,385 | B1 * | 11/2006 | Ehlers et al. | 114/145 R |
| 7,140,315 | B2 | 11/2006 | Okuyama | |
| 7,188,581 | B1 | 3/2007 | Davis et al. | |
| 7,188,591 | B2 * | 3/2007 | Long | 123/90.11 |
| 7,216,599 | B2 | 5/2007 | Morvillo | |
| 7,222,577 | B2 | 5/2007 | Morvillo | |
| 7,234,983 | B2 * | 6/2007 | Davis | 440/68 |
| 7,238,065 | B2 * | 7/2007 | Bremsjo et al. | 440/1 |
| 7,267,068 | B2 | 9/2007 | Bradley et al. | |
| 7,267,069 | B2 | 9/2007 | Mizutani | |
| 7,270,068 | B2 | 9/2007 | Mizutani | |
| 7,294,031 | B1 * | 11/2007 | Davis et al. | 440/112 |
| 7,305,928 | B2 | 12/2007 | Bradley et al. | |
| 7,371,140 | B2 * | 5/2008 | Davis | 440/69 |
| 2007/0224892 | A1 | 9/2007 | Davis | |
| 2008/0015746 | A1 | 1/2008 | Bertazzoni | |

* cited by examiner

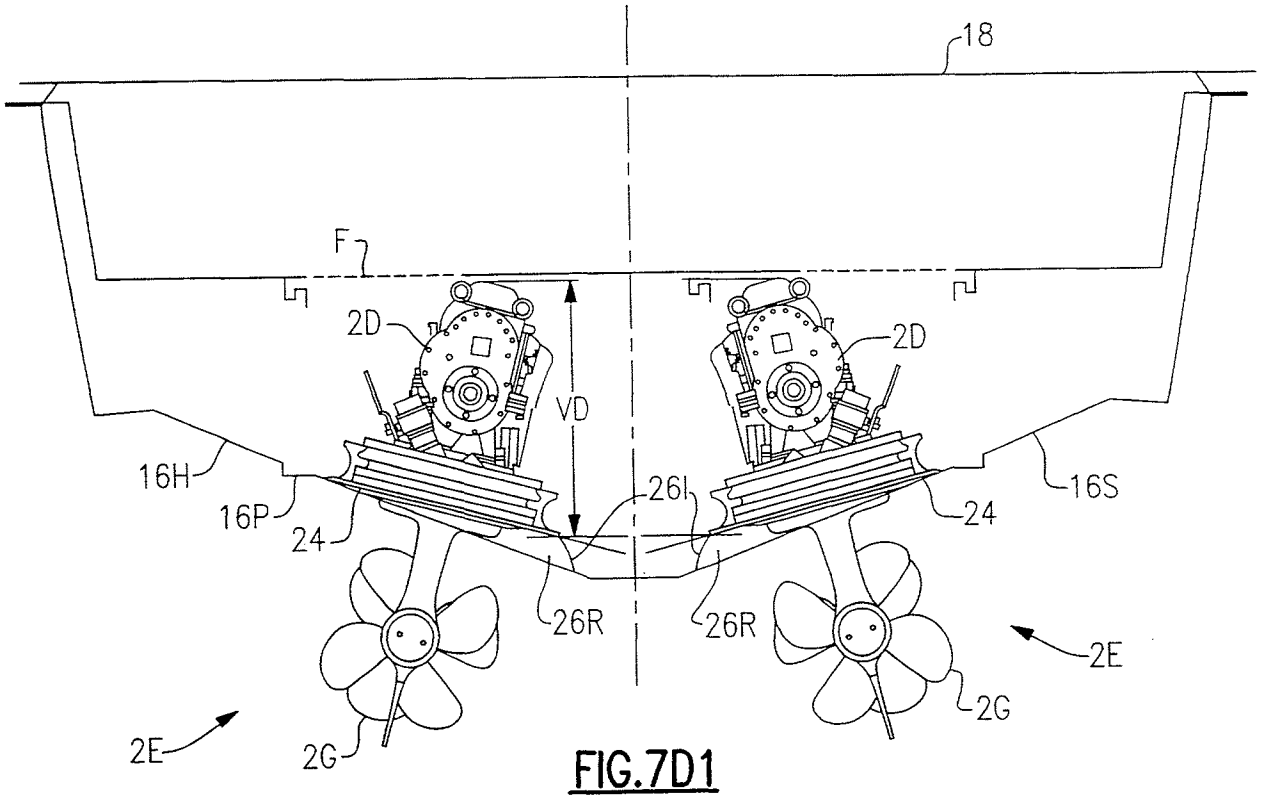
FIG.7D1

POD DRIVE INSTALLATION AND HULL CONFIGURATION FOR A MARINE VESSEL

FIELD OF THE INVENTION

The present invention relates to methods and structures for installing propulsion and steering devices into a marine vessel and, in particular, to methods and structures for mounting pod drives into a marine vessel and hull configurations for mounting pod drives.

BACKGROUND OF THE INVENTION

Pod drive systems, for propelling and steering marine vessels, typically comprise of one or more pod drive units wherein, as illustrated in FIG. 1, each pod drive unit 2A of a pod drive system 2 typically includes an inboard engine 2B which drives a drive shaft 2C that, in turn, drives an inboard transmission unit 2D that is connected to and drives an underwater steerable gearcase 2E that is rotatably mounted through the hull 2F and supports and drives a propeller 2G. As generally indicated in FIG. 1, engine torque is transmitted from a generally horizontal drive shaft 2C, through a first bevel gear assembly 2H, to a generally vertical arranged intermediate drive shaft 2I extending downwardly through inboard transmission unit 2D to the steerable gearcase 2E. The engine torque of the vertical intermediate drive shaft 2I is, in turn, transmitted through a second bevel gear assembly 2J to a propeller shaft 2K which, in turn, supports and drives a propeller 2G. The pod drive unit 2A allows the propeller 2G to be rotated in the generally horizontal plane, about a steering axis 2L, and through an angular range of, for example, up to 360°, so that the pod drive unit 2A combines and forms both the vessel propulsion function as well as the steering function. The selection of the appropriate maximum starboard and port steering angles will depend on the desired steering performances and design constraints and choices, such as the type of vessel, the design and characteristics of the vessel hull and the desired manoeuvring characteristics.

Pod drive systems, also referred to as azimuthing propulsion systems or azimuth thrusters, have become popular and common in vessels of all sizes for a number of real and perceived advantages. For example, pod drive systems are typically more compact than and offer greater manoeuverability than systems having inboard engines or non-steerable propellers and rudders and are better protected from damage and offer greater manoeuverability than outboard drive systems and many propeller and rudder systems.

However, pod drive systems present a number of problems. Pod drive systems, of various configurations, are used in a wide range of marine vessels ranging from small pleasure craft to large work vessels, such as commercial fishing vessels, and even large ships, such as cruise liners. The common problems of installing and using pod drive systems in pleasure craft are illustrative, however, to a greater or lesser degree, of the typically problems associated with using pod drive systems in all types of vessels and will be discussed below as examples of these problems.

FIGS. 2 through 6 are illustrations of various pod drive systems of the prior art as installed in a vessel having a V-bottomed planing hull with twin pod drive units mounted through the hull, as shown in FIGS. 2 through 4, at symmetrical positions on either side of the hull keel or centerline. Those of ordinary skill in the relevant arts will recognize, however, that such V-bottom hulls, and variations thereof, are commonly used on a variety of other vessels, including commercial and work craft, and vessels having rounded or curved bottoms will present similar problems because the pod drive units must be mounted on sections of the hull that are at an angle to both the vertical plane and the horizontal plane. It will also be recognized that at least some of the same or similar problems appear with flat bottomed hulls as well as will be apparent from the following discussion.

Referring again to FIGS. 2 and 3, a tunnel pod drive system 2 is shown therein as adopted, for example, by the Brunswick Corporation of Lake Forest, Ill. and described in U.S. Pat. Nos. 7,371,140 and 7,188,581 issued to Richard A. Davis for a Protective Marine Vessel and Drive and in European Patent Application Serial No. 1 777 154 A2 filed on Sep. 26, 2006 and published on Apr. 25, 2007.

As shown in FIGS. 2 and 3, but not in FIG. 4, the installation of twin pod drive units 2A in the V-bottom hull 4H requires the formation of corresponding open bottomed "tunnels" 4T, or canyons, on either side of the keel 4K with each pod drive unit 2A extending into a corresponding tunnel 4T through the top 4O of the tunnel 4T with underwater steerable gearcases 2E extending vertically below the tunnel top 4O and residing largely within the tunnels 4T. The propellers 2G are located partially within or extend largely below the bottom 4B of hull 4H and the steering axes 2L are generally oriented vertically. The forward ends of tunnels 4B are typically closed by a forward end wall 4F, for structural reasons, such as reducing the interior volume of hull 4H occupied by the tunnels 4T, while the aft ends 4R of tunnels 4T are open to permit the flow of water through the tunnels 4T and around the steerable gearcases 2E and the propellers 2G.

A primary advantage of a tunnel pod drive system 2, as illustrated in FIGS. 2 and 3, is that pod drive units 2A, and in particular steerable gearcases 2E and to a certain extent the propellers 2G, are better protected because pod drive units 2A are raised or recessed vertically, relative to the keel 4K, thereby at least partially protecting pod drive units 2A from striking an underwater object(s). Other possible advantages are that the navigational draft of the vessel is typically reduced allowing more water areas to be safely navigated by the vessel, and that steering by the thrust generating elements, that is the propellers 2G, generally allows greater manoeuverability and improved vessel handling characteristics.

However, a major disadvantage of a tunnel pod drive system 2, as illustrated in FIGS. 2 and 3, is the effect on hull characteristics caused by modifications to the hull to accommodate the tunnels 4T, particularly when an existing hull is modified for tunnel mounting of pod drive units 2. For example, the installation or provision of tunnels 4T not only results in significant structural changes to the hull but also reduces the amount of buoyancy of the vessel, toward the stern end thereof, thus reducing and/or redistributing the buoyancy of the vessel. The tunnels 4T have also been found to reduce the planing surface at the stern, thereby causing a "squatting" or "sinking" effect of the stern of the vessel that has been found to increase further in the event that the depth of tunnels 4T within the vessel is increased.

Other disadvantages are that the "wetted surface area" of the hull 4H is increased by the tunnels 4T, thereby increasing the frictional drag of hull 4H and correspondingly reducing the vessel speed while also increasing fuel consumption. The tunnels 4T have also been found to cause redirection of the flow of water around hull 4H, thereby further increasing the drag of the hull 4H. It has been found that the tunnels 4T may channel the flow of water, generated by the propellers 2G, thereby creating low pressure fields that result in a downward force, on the aft region of the hull, that may adversely effect vessel trim angles.

An alternate method for mounting pod drive units in twin engine V-bottom vessels is the slanted steering axis system 4 that has been adopted, for example, by the Volvo Penta system of Volvo Corporation of Greensboro, N.C. which is described, for example, in U.S. Pat. No. 7,033,234 issued to Arvidsson for Watercraft Swivel Drives and in U.S. Pat. No. 5,755,605 issued to Asberg for a Propeller Drive Unit, and in International Patent Applications WO96/00682 and WO96/00683.

As shown in isometric view in FIG. 4, the pod drive units 2A are mounted directly to hull 4H, in a slanted steering axis pod drive system 4, so that the steering axis 2L of each pod drive unit 2A is normal to the port and the starboard surfaces 4P and 4S of the hull 4H and is thereby at an angle to the vertical axis of the vessel.

A major advantage of the slanted steering axis pod drive system 4 is that the system does not require any tunnels 4T to adapt the pod drive units 2A to the hull 4H. The slanted axis system 4 thereby does not require any significant modification(s) to the shape or the structure of the hull 4H, does not effect or alter the buoyancy or distribution of the buoyancy or the trim of the hull, the fluid flow around the hull, the wetted surface area or the drag of the hull or some of the handling characteristics of the hull and, for example, does not result in low pressure areas in the aft regions of the hull with consequent "squatting" or "sinking" effects.

The pod drive units of FIG. 4 are, however, more exposed to damage in the slanted axis pod drive system 4, and the system typically results in the pod drive units, and thus the vessel, having an increased draft as compared to a tunnel mount system. Yet another aspect of the slanted steering axis pod drive system 4 is that, as can be seen from FIG. 4, the tilt of steering axes 2L—relative to a substantially vertical axis—results in each pod drive unit 2A producing a vertical component of thrust from the propeller 2G in addition to the horizontal component of thrust. The magnitude and direction of the vertical component of thrust, that is, either upward or downward, depends upon the direction and angle at which the propeller 2G is rotated and the slanted steering axis pod drive systems may be used, for example, to trim the running position of the vessel. That is, the pod drive units 2A may be rotated in opposite directions by an angle of rotation selected so that the horizontal components of the thrusts generated by the two pod units 2A cancel each other while the vertical components of the thrust, generated by each unit, is added to exert an upward or downward force on the stern of the vessel and to thereby adjust the fore/aft trim of the vessel to a desired setting or value. The rotations of the two pod drive units may be dynamically adjusted, in this way, to control the fore/aft trim of the vessel for various speeds or loading conditions, and may be used, for example, to adjust the fore/aft trim of the vessel during a transitory period, such as assisting the vessel over the planing threshold when transitioning from the displacement mode to the planing mode.

The generation of an upward or downward force on the vessel by a slanted steering axis drive system when the pod drive units are rotated is disadvantageous, however, because this effect often generates a "rolling" force and effect on the vessel during turns. That is, during a left or a right turn for example, the propellers 2G, of both pod drive units 2A, rotate about their steering axes 2L toward the left or right hand turn so that both pod drive units 2A exert a horizontal thrust component toward the inside of the turn, thereby forcing the stern toward the outside of the turn and forcing the vessel to turn in the desired direction. The rotation of the pod drive units 2A toward the inside of the turn, however, results in the vertical thrust generated by the inside pod drive unit 2A, that is, the pod drive unit 2A toward the inside of the turn, being directed downward while the vertical thrust component generated by the outside drive pod 2A is directed upward.

The combined vertical thrust components from the drive pod units 2A, in a slanted steering drive system 4 according to FIG. 4, thereby may exert a force during a turn that causes the vessel to have an unwanted rolling motion toward the inside of the turn. It has been found that this unwanted effect increases with the deadrise of the hull, that is, the angle of rise of the port and the starboard halves of the hull on either side of the keel. The rolling effect also places addition constraints on the center of gravity of the vessel because the center of gravity must be kept as low as possible to reduce excessive roll angles, during turns, and in the design of the transom because the height of the transom must be sufficient to accommodate the shift in the waterlines as the vessel rolls during turns.

Lastly, FIGS. 5 and 6 illustrate yet further embodiments of the pod drive systems. FIG. 5 is an isometric view of a single tunnel pod drive unit 2A installed in a tunnel 47 extending along the aft keel 4K of the hull 4H. It should be noted that, in FIG. 5, the pod drive unit 2A shown therein is a "tractor" propulsion unit. That is, the blade pitch of the propeller 2G and the orientation of the steerable gearcase 2E are reversed, with respect to the propellers 2G and the gearcases 2E illustrated in FIGS. 2 through 4, so the propeller 2G accordingly exerts a "pulling or traction" force on the vessel rather than the "pushing" force exerted by the propellers 2G and the gearcases 2E of the pod drive units 2A shown in FIGS. 2 through 4.

FIG. 6, in turn, is a rear view of the single tunnel pod drive system of FIG. 5 combined with the dual slanted steering axis pod drive system 4 of FIG. 4 to provide a triple pod drive system. It will be noted that in the illustrated combined pod drive system, the gearcase 2E and the propeller 2G are implemented as "pushing" units as shown in FIGS. 2 through 4, rather than a "tractor" or "pulling" unit as illustrated in FIG. 5. It will be understood, without further any discussion, that the system of FIG. 5 could also be combined with the system of FIGS. 2 and 3 to provide an alternate implementation comprising a triple tunnel pod drive system, providing either a pushing or a pulling force. It will be appreciated, however, that all such approaches to the problems of the pod drive systems of the prior art will generally have the same disadvantages as the embodiments illustrated in FIGS. 2 through 4.

The present invention is directed at addressing and overcoming the above noted problems as well as other problems associated with the known prior art systems.

SUMMARY OF THE INVENTION

The present invention is directed to a pod drive installation for mounting a pod drive unit to a hull of a vessel and hull configurations for mounting of one or more pod drive units to the hull of a vessel.

A pod drive installation of the present invention comprises a generally horizontally disposed pod drive platform for supporting a rotational pod drive mount for mounting the pod drive unit with a generally vertically oriented steering axis wherein the pod drive platform has a width which extends generally perpendicular to a keel of the vessel and a length that extends generally parallel to the keel of the vessel so as to accommodate at least the rotational pod drive mount. In general, the length of the pod drive platform and the length of one or both of the inboard and output sidewalls extending parallel to the keel of the vessel and are typically greater than the width of the pod drive platform.

The pod drive platform is mounted to the hull outward of the keel of the vessel so that the pod drive platform generally intersects a plane defined by a bottom hull surface tilted from the horizontal at a contour of intersection between an outboard boundary and an inboard boundary of the pod drive platform or at a contour located at or adjacent to either the outboard or inboard boundary of the pod drive platform, and is connected to the bottom hull surface by at least one of an outboard sidewall and an inboard sidewall.

The pod drive platform, the bottom hull surface and either or both of the outboard sidewall and the inboard sidewall form one, or both, of an outboard protrusion from the bottom hull surface and a recess into the bottom hull surface and either or both of the inboard and outboard sidewalls form a fairing, between the pod drive platform and the bottom hull surface. The increase or decrease in hull volume and the wetted surface area, in the region of the pod drive unit or units due to the mounting of the pod drive platform or platforms into the hull, is thereby significantly reduced compared to the volume and wetted surface area of the hull in this region for a bottom hull surface not including the hull drive pod platform or platforms.

According to the invention, each pod drive unit includes an inboard propulsion device for driving an inboard transmission unit that drives an underwater steerable gearcase that is rotatably mounted, through the hull, by the rotational pod drive mount to rotate about the steering axis and drive a propeller, and the hull of the vessel is one of a generally V-shaped hull and a hull having a generally curved shape.

Further aspects of the present invention are directed to configurations of the hull adjacent to and including the pod drive platforms to provide hull contours that minimize disadvantageous effects on the hull, such as, for example, an undesirable reduction in or distribution of buoyancy or trim of the hull, an excessive wetted surface area and consequent drag of the hull, undesirable fluid flow paths around the hull that, for example, result in undesirable low or high pressure areas in the aft regions of the hull, and undesirable handling characteristics.

The present invention further includes hull configurations for the mounting of pod drive installations.

In a first embodiment of a presently preferred hull configuration for mounting at least a port pod drive unit and a starboard drive unit to a hull of a vessel, the vessel includes at least one pod drive platform for supporting at least one rotational pod drive mount for mounting at least one pod drive unit symmetrically with respect to a keel of the vessel wherein each pod drive platform has a width and a length accommodating the corresponding rotational pod drive mount, and the hull has a triangular hull configuration.

A "delta" (or triangular) hull configuration includes a pod drive mounting plane extending on either side of a keel of the hull and supporting the at least one horizontal pod drive platform and a triangular fairing connecting the pod drive platform to a corresponding bottom hull surface, wherein the triangular fairing includes a generally triangular fairing extending forward and downward from a fairing inflection line, at the forward end of pod drive mounting plane, and to a triangular fairing intersection point with the keel at a presently preferred angle in the range of 7 degrees plus or minus 4 degrees relative to the plane of the keel. A fairing being a member or structure whose primary function is to produce a smooth outline and to reduce drag The triangular fairing has a doubly curved surface including a downwardly convex transversely extending arc toward the aft section of the triangular fairing and an upwardly concave transversely extending arc toward the front section of the triangular fairing with the triangular fairing being tangent with the plane of the pod drive mounting plane at the fairing inflection line and with a plane of keel at the triangular fairing intersection point, so that the pod drive mounting plane and triangular fairing together have outer boundary contours formed by an intersection of the pod drive mounting plane and the triangular fairing with the bottom hull surfaces.

An alternate embodiment of the triangular hull configuration, includes port and starboard horizontally disposed pod drive platforms for supporting corresponding respective port and starboard rotational pod drive mounts for mounting port and starboard pod drive units wherein each pod drive platform has a width and a length size to accommodate the corresponding rotational pod drive mount and being mounted to the hull outward of the keel of the vessel so that each pod drive platform intersects a bottom hull surface along a contour of intersection between an outboard boundary of the pod drive platform and the bottom hull surface.

The triangular hull configuration for mounting multiple pod drive units and platforms may further include a volume/planing structure, axially centered along the keel, and having a width extending across the pod drive mounting plane, between inside boundaries of the pod drive platforms, and a length extending generally from an aft end of pod drive mounting plane to a point between the fairing inflection line and the triangular fairing intersection point with the keel and having a height relative to the pod drive mounting plane that is one of less than and equal to a projected height of the keel with respect to the pod drive mounting plane, at the aft end of the pod drive mounting plane and a forward edge fairing into the triangular fairing.

A still further embodiment of the present invention includes a "warp" (or curved) hull configuration for mounting at least a port pod drive unit and a starboard drive unit to a hull of a vessel on port and starboard horizontally disposed pod drive platforms for supporting corresponding respective rotational pod drive mounts for mounting port and starboard pod drive units.

The curved hull configuration includes a curved fairing for and corresponding to each pod drive platform for fairing each pod drive platform to a corresponding bottom hull surface wherein each curved fairing includes a generally vertical sidewall fairing and a generally horizontal curved surface.

Each sidewall fairing has an upper boundary defined by an intersection of the sidewall fairing with the curved surface, a lower boundary defined by an intersection of the sidewall fairing with a bottom hull surface, a forward extremity formed by a converging intersection of the upper boundary and lower boundary at the hull surface, and an aft boundary defined by a line of intersection between the sidewall fairing and an inside boundary of the corresponding one of the pod drive platforms at a forward edge of the corresponding pod drive platform.

Each horizontal curved surface has an inner boundary extending along an intersection of the curved surface and the upper boundary of the sidewall fairing, an boundary extending along an intersection between the curved surface and the forward edge of the corresponding pod drive platform, and an outer boundary extending forward from and in continuation of an outer boundary of the pod drive platform and along the hull surface to a forward boundary of the curved surface, wherein the forward boundary of the curved surface extends transversely from the forward extremity of the sidewall fairing and along the hull surface to the outer boundary of the curved surface. An aft portion of each curved surface is curved to tangentially intersect the forward edge of the corresponding pod drive platform and the aft boundary and a forward portion of each curved surface is curved to tangentially intersect the bottom hull surface along the forward boundary of the curved surface.

The term "horizontal," as used in this description and in the accompanying claims, means that the platform is generally horizontal when the vessel is in an upright position and floating, without power, in water such that the pod steering axis is substantially normal to a top surface of the water.

The term "pod drive unit," as used in this description and in the accompanying claims, means a pod drive system which includes an inboard engine, with or without a transmission, that drives a drive shaft which, in turn, drives an inboard transmission unit that is connected to and drives an underwater steerable gearcase, rotatably mounted through the hull, which supports and drives a propeller.

BRIEF DESCRIPTION OF THE DRAWINGS

The above discussed aspects of the prior art and the following discussed aspects of the present invention are illustrated in the accompanying figures, wherein:

FIG. 7D1 is a diagrammatic rear view, similar to FIG. 7D, showing a slight modification thereof;

FIGS. 7G, 7H and 7I, respectively, are a rear elevational view, a right side elevational view and a bottom perspective view of another embodiment of the dual pod drive system according to the present invention for a V-bottom hull while

DETAILED DESCRIPTION OF THE PREFERRED EMBODIMENTS

A. Methods and Structures for Mounting Pod Drives into a Vessel

Figure 7A:
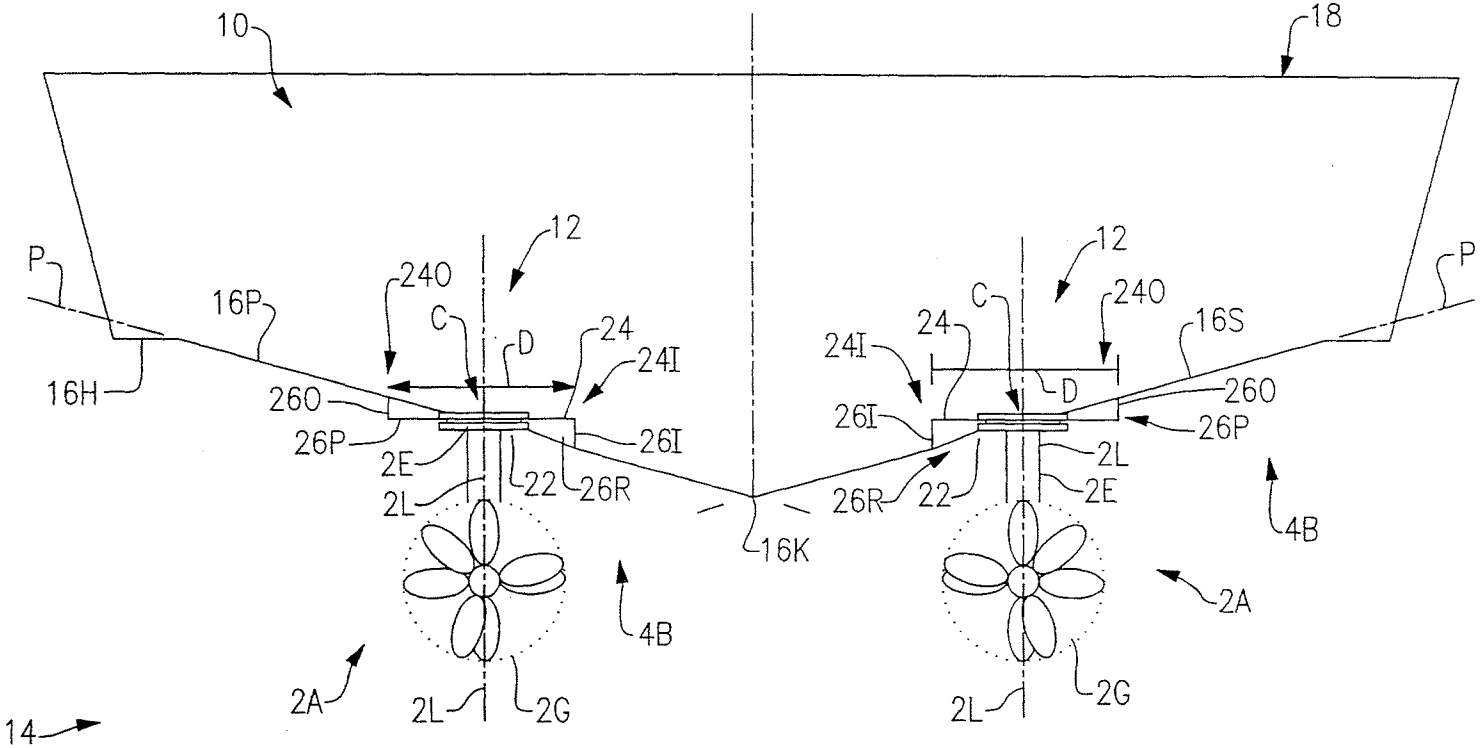
FIGS. 7A and 7B are diagrammatic rear and bottom plan views, respectively, of a dual pod drive system according to the present invention for a V-bottom hull.
Figure 7B:
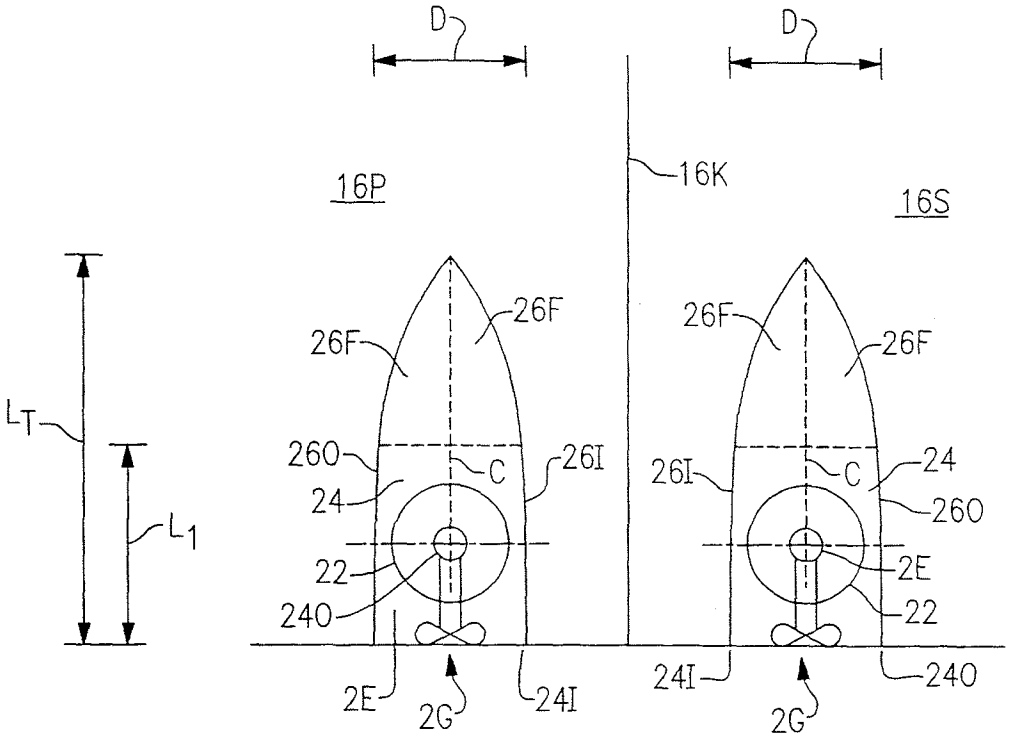

Referring to FIGS. 7A and 7B, diagrammatic rear and bottom views of the pod drive installations 10 of the pod drive units 12, of an exemplary pod drive system 14 of the present invention as implemented for a V-bottom hull 16H of a vessel 18, are shown although it will be appreciated, in view of the following description, that the pod drive system 10 of the present invention may be similarly implemented, for example, in vessels having rounded or curved bottom hulls as well.

Figure 1:
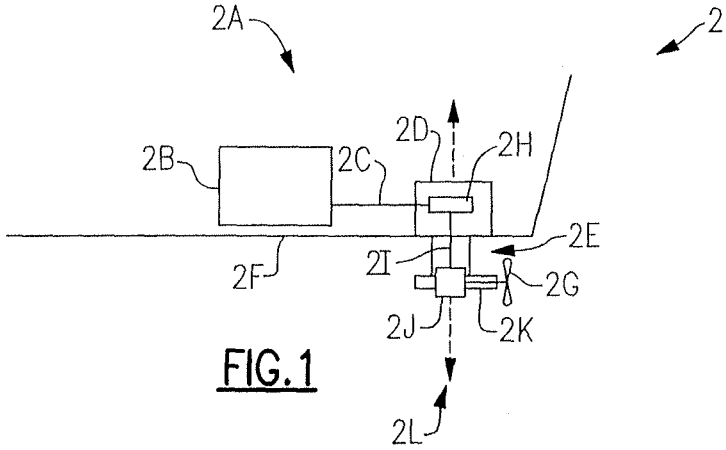
FIG. 1 is a diagrammatic illustration of a prior art pod drive unit.
Figure 6:
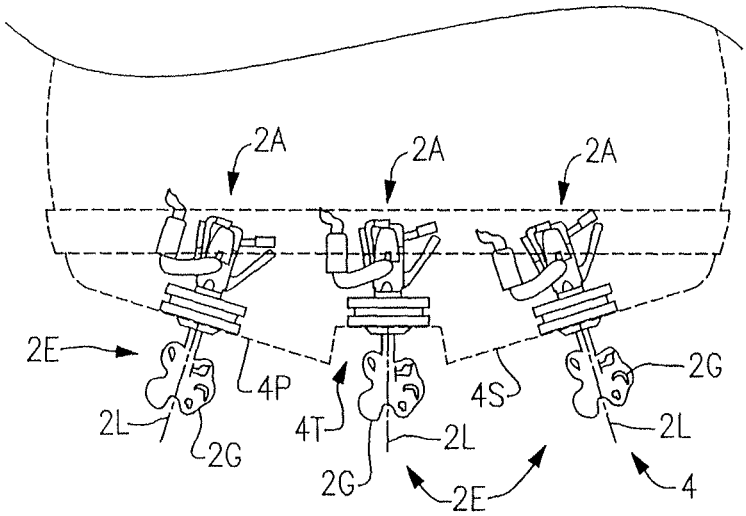
FIG. 6 is a rear view of a pod drive system of the prior art comprising a single tunnel pod drive unit in combination with dual slanted steering axis pod drive units installed in a V-bottom hull.
Figure 2:
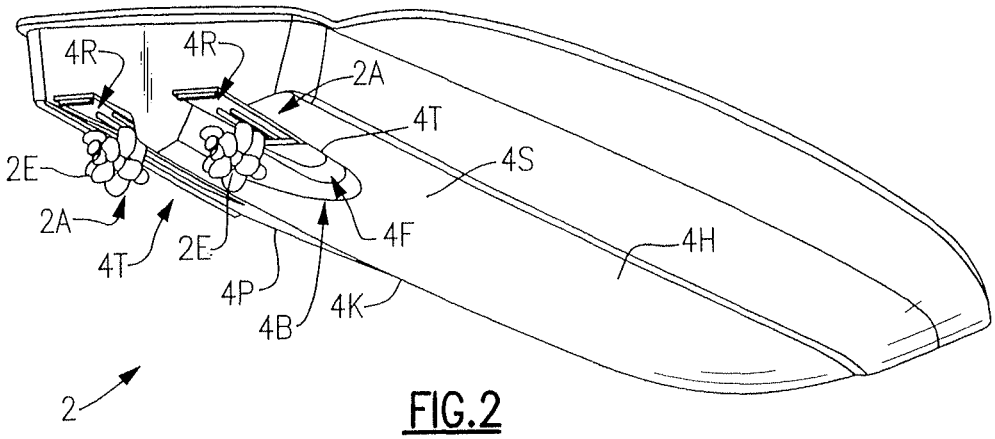
FIG. 2 is an isometric view of a dual tunnel pod drive system of the prior art for a V-bottom hull.

As shown therein, the exemplary pod drive system 10 includes two pod drive units 12—each of which is similar to the design illustrated in FIG. 1—typically comprises an inboard engine (not shown) driving a drive shaft (not shown) that drives an inboard transmission unit (not shown) that is connected to and drives an underwater steerable gearcase 2E that is rotatably mounted through the hull 16H which supports and drives a propeller 2G. As with the case of the pod drive system 2 of FIG. 1, engine torque is transmitted from generally horizontal drive shaft and through a first bevel gear assembly to a generally vertical intermediate drive shaft extending downwardly between inboard transmission unit and the steerable gearcase 2E, wherein the torque drives the vertical intermediate drive shaft (now shown) and is transmitted through a second bevel gear assembly (not shown) to the propeller shaft which supports and drives the propeller 2G, with propeller 2G being rotatable about vertical steering axis 2L.

It should be noted that in the exemplary pod drive system 14 of FIGS. 7A and 7B, the propellers 2G of the port and the starboard pod drive units 12 are, in a presently preferred embodiment, counter-rotating propellers so as to avoid the generation of any turning torque on the vessel 18, as is often found in marine drive systems having symmetrically located port and starboard propulsion units or propellers. It should also be noted that the deadrise angle of V-bottom hull 16H, in the illustrated embodiment, is, for example, approximately 15.5°, but may be any angle in the conventional deadrise angle range of 0° to 26°.

Figure 14:
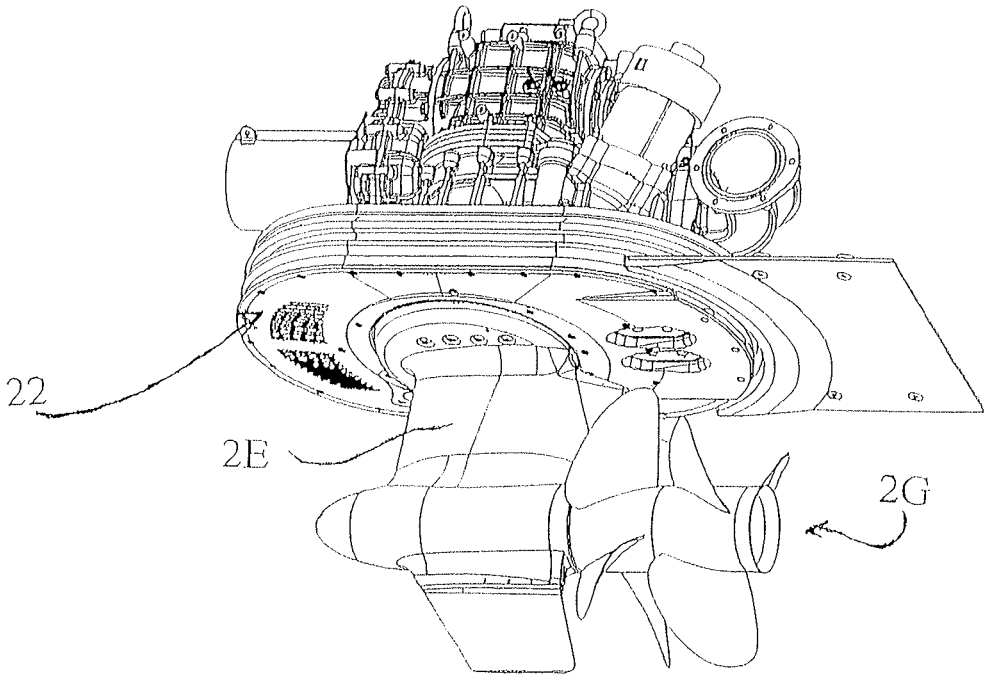
FIG. 14 is an exemplary illustration of a rotational pod mount for the installation of a pod drive unit in a hull.

As also shown in FIGS. 7A and 7B and in FIG. 14, the steerable gearcase 2E of each pod drive unit 12 is rotatably mounted upon and through a rotational pod mount 22 that includes the necessary structural and mechanical elements, including sealing elements necessary to support the rotating steerable gearcase 2E and the associated steering and drive elements of the pod drive unit 12 to and through the hull 16H, as described herein above with reference to FIG. 1. The structural requirements of the rotational pod mount 22, and the means and structural elements by which a steerable gearcase 2E and the associated drive elements are mounted to and through such a rotational pod mount 22 and sealed against leakage, are well known to those of ordinary skill in the arts and, as such, are not described in any further detail herein. An exemplary implementation of the rotational pod mount 22 is illustrated in FIG. 14 and described in U.S. Patent Application Publication No. 2007/0224892 published Sep. 27, 2007 and U.S. Patent Publication No. 2007/0093150 published Apr. 26, 2007, both by Davis for a Protective Marine Vessel and Drive, as well as in similar references.

In the pod drive installation 10 of the present invention, the rotational pod mount 22, and thereby the pod drive unit 12, is mounted to a horizontally oriented pod drive platform 24 with one or more pod drive platforms 24 being positioned symmetrically, on either side of the keel 16K, on each of the port and the starboard hull surfaces 16P and 16S of the bottom of the hull 16H so that the steering axis 2L, for each pod drive unit 12, is substantially vertically oriented.

As shown in FIGS. 7A and 7B, each pod drive platform 24 has a horizontal width D along the platform dimension which extends perpendicular to the keel 16K, that is across hull 16H, such that the width D is at least equal to or greater than the diameter of rotational pod mount 22 and is sufficient to at least accommodate and support the rotating steerable gearcase 2E and associated steering and drive elements of the pod drive unit 12. Each pod drive platform 24 also has a horizontal length, along the platform dimension which extends parallel to the keel 16K (see FIG. 7B), that is longitudinal along the longitudinal length of the hull 16H, wherein the pod length $L_1$ is equal to or greater than the diameter of the rotational pod mount 22 and at least a section of the longitudinal length is sufficiently long and horizontally flat so as to at least accommodate and support rotating steerable gearcase 2E and any associated steering and drive elements of the pod drive unit 12. The total length $L_T$ of recess or cut out is also sufficiently long enough to "fair" the pod drive platform 24 into either the port or the starboard bottom hull surfaces 16P and 16S of the hull 16H, as described below in further detail.

According to the present invention, and as illustrated in FIGS. 7A, 7C, 7D and 7D1, each pod drive platform 24 is positioned along the width of the corresponding one of the port hull surface 16P and the starboard hull surface 16S so that the horizontal plane, formed by the pod drive platform 24, intersects an inclined plane P, formed and defined by the corresponding one of the port bottom hull surface 16P and the starboard bottom hull surface 16S. As shown in FIGS. 7A, 7C, 7D and 7D1, the line or contour of intersection C, between the pod drive platform 24 and the corresponding one of the port hull surface 16P and the starboard hull surface 16S may be located at any point between the inboard and the outboard boundaries 24I and 24O of the pod drive platform 24, depending upon the location of the pod drive platform 24. It is to be appreciated that the contour of intersection C may be a straight line or may also be, depending upon the shape and curvature of the bottom of the hull and the shape and/or orientation of the pod drive platform 24, a curved edge, a curved arc, a rounded or curved segment, etc.

Figure 7C:
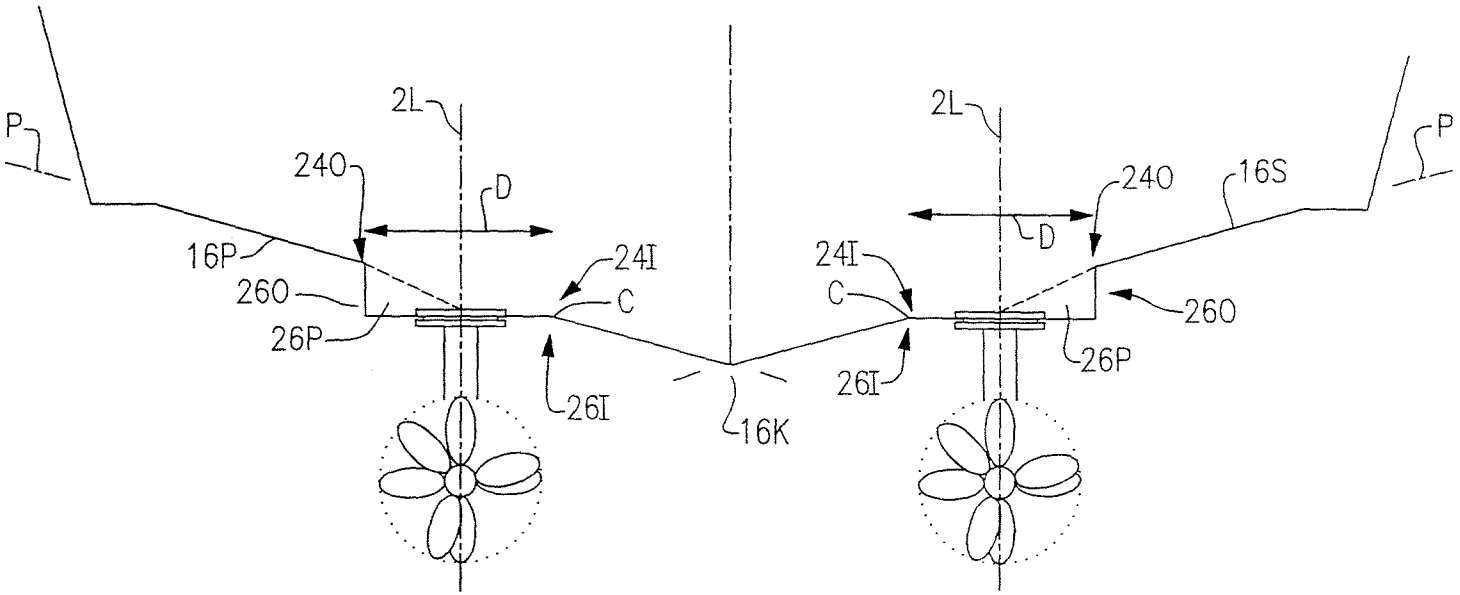
FIGS. 7C and 7E are diagrammatic rear and bottom plan views, respectively, showing an alternative arrangement of a dual pod drive system according to the present invention for a V-bottom hull.

FIG. 7A illustrates an installation wherein the contour of intersection C is located at approximately the midpoint of the width D of the pod drive platform 24 and extends generally parallel to the keel 16K. FIG. 7C, on the other hand, illustrates a case in which the contour of intersection C is located at or adjacent to the inboard extremities 24I of the pod drive platforms 24, while FIGS. 7D and 7D1 illustrate installations wherein the contour of intersection C is located at or adjacent to the outboard extremities 24O of the pod drive platforms 24.

Figure 7D:
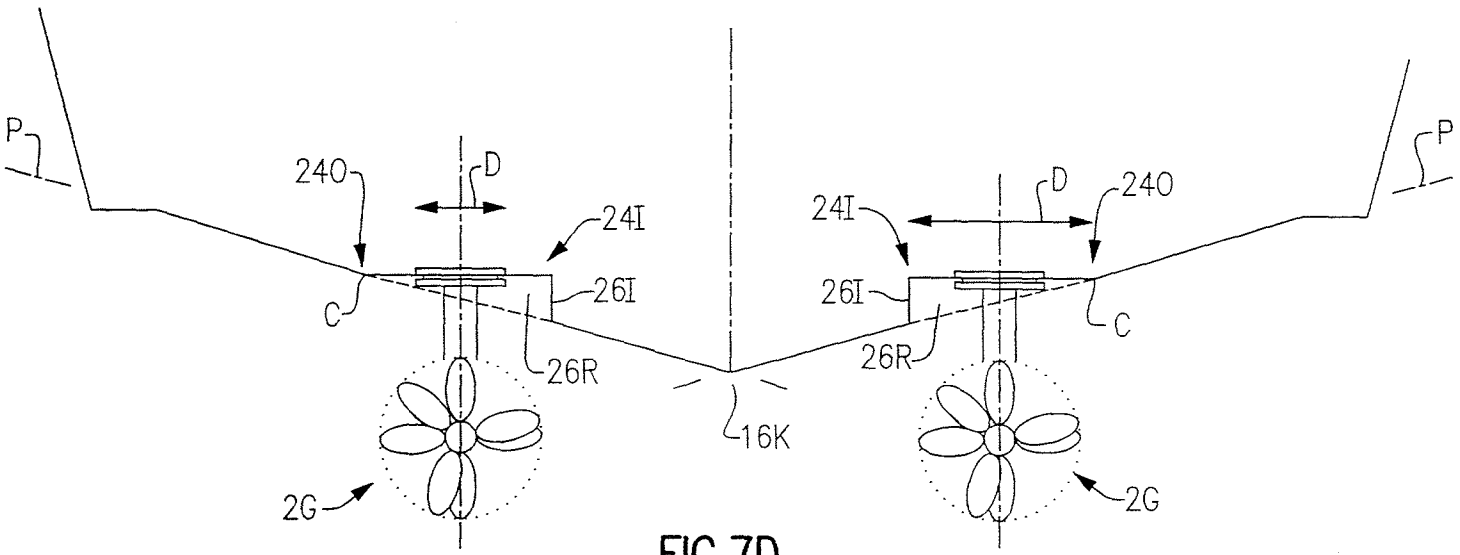
FIGS. 7D and 7F are diagrammatic rear and bottom plan views, respectively, showing a further alternative arrangement of a dual pod drive system according to the present invention for a V-bottom hull.

As can be seen from FIGS. 7A, 7C, 7D and 7D1, the relationship of the pod drive platform 24, relative to the port and the starboard bottom hull surfaces 16P and 16S, will result in the pod drive platform 24 mating or joining with the port and the starboard bottom hull surfaces 16P and 16S by at least one of a wedge shaped outboard protrusion 26P and/or a wedge shaped inboard recess 26R, or both, relative to hull surfaces 16P and 16S, and depending on the contour of intersection C formed between pod drive platform 24 and the bottom hull surfaces 16P and 16S. As illustrated in FIG. 7A, which illustrates an intermediate location of the intersection point, the pod drive platform 24 will, in this case, include and be connected to the port and the starboard bottom hull surfaces 16P and 16S by inboard and outboard sidewalls 26I and 26O, forming respective wedge shaped outboard protrusions 26P from the hull surfaces 16P and 16S as well as respective wedge shaped inboard recesses 26R into the hull surfaces 16P and 16S. As illustrated in the cases where the contour of intersection C is located at or adjacent to either the inboard or the outboard boundary 24I or 24O of the pod drive platforms 24, the pod drive platforms 24 will include and be connected with the port and the starboard bottom hull surfaces 16P and 16S by either wedge shaped outboard protrusions 26P from the hull surfaces 16P and 16S formed by outboard sidewalls 26O, as illustrated in FIG. 7C, or wedge shaped inboard recesses 26R into the hull surfaces 16P and 16S formed by inboard sidewalls 26I, as illustrated in FIGS. 7D and 7D1.

It will be appreciated from FIGS. 7A, 7C, 7D and 7D1 that the increase or decrease in hull volume and the wetted surface area of the hull, in the region of the pod drive unit or units due to the mounting of the pod drive platform or platforms into the hull, is thereby significantly reduced compared to the volume and wetted surface area of the hull in this region for a bottom hull surface not including the hull drive pod platform or platforms.

Figure 3:
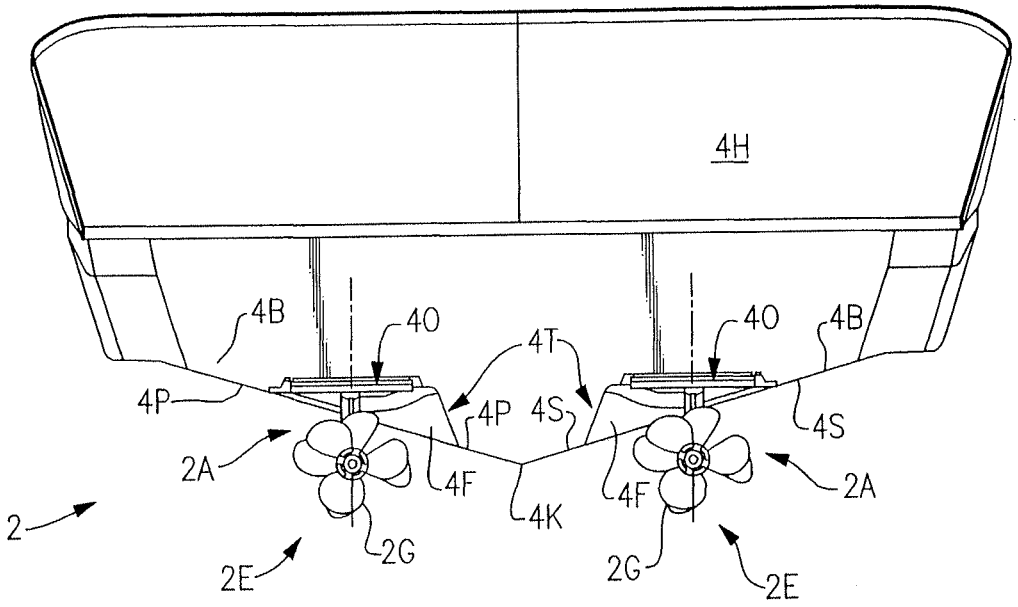
FIG. 3 is a rear view of a dual tunnel pod drive system of FIG. 2.
Figure 4:
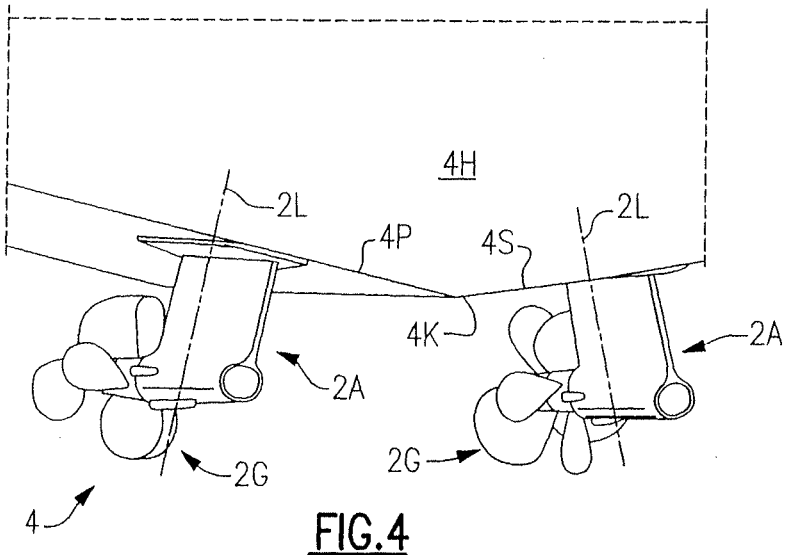
FIG. 4 is an isometric view of a dual slanted steering axis pod drive system of the prior art for a V-bottom hull.
Figure 5:
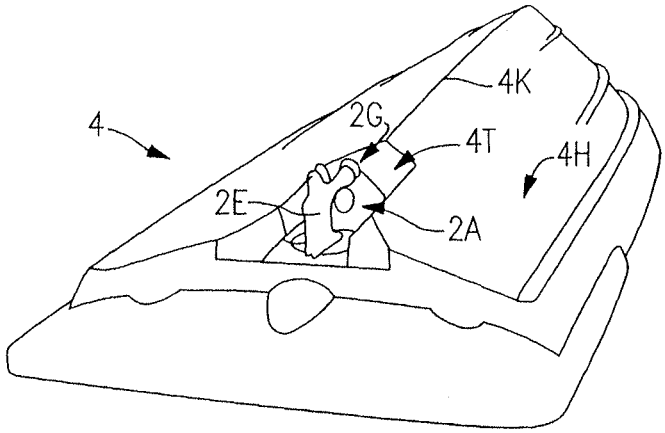
FIG. 5 is an isometric view of a single engine pod drive system of the prior art for a V-bottom hull.

It will also be appreciated that the location or locations of a pod drive platform 24 or pod drive platforms 24, relative to bottom hull surface 16P and 16S, may be displaced vertically by a relatively small amount, as compared to the positions shown in FIGS. 7A, 7C, 7D and 7D1, without deviating from the above described principles of the present invention where such modifications in the vertical position of the pod drive platforms 24 are minor compared to the vertical positions of systems of the prior art, as described with reference to FIGS. 1, 3 and 5 for example. Such adaptations may be necessary or desirable for a number of reasons, such as an adaptation to internal structures of the hull or to reduce the protrusion of elements of a pod drive unit 2A, such as steerable gearcase 2E, into the water flow paths in the region of a pod drive system 2 with consequent unwanted disturbances in the water flow around the hull and pod drive units 12 in this region.

Turning now to FIG. 7D1, a brief discussion concerning the minor variation of this embodiment will now be discussed. In virtually all respects, except for the orientation of the pod drive platform 24, which slopes or forms an angle of about 15 degrees instead of being substantially horizontal as with embodiment of FIG. 7D, the embodiment of FIG. 7D1 is substantially identical to the embodiment of FIG. 7D. In view of these similarities, in this Figure identical elements are given identical reference numerals.

As shown in FIG. 7D1, if the vertical height of the inboard transmission unit 2D will extend too far vertically upwardly into the interior compartment of the hull 16H of the vessel 18, it may be necessary or desirable, in some applications, to alter the orientation of the pod drive platform 24 so that the two opposed pod drive platforms 24 are not substantially parallel with one another. That is, each pod drive platform 24 may slope downwardly toward the keel 16K to form an angle of generally between about 1 and about 15 degrees—an angle of 15 degrees is depicted in FIG. 7D1. As a result of such modification to the pod drive platforms 24, the inboard transmission units 2D do not extend vertically upwardly (distance VD in FIG. 7D1) as far into the interior section of the hull 16H of the vessel 18 and thus can be readily accommodated vertically below the floor F of the vessel 18. It is to be appreciated that such modification to the orientation of the pod drive platforms 24 may be necessary to accommodate vertically tall or large inboard transmission units 2D within a smaller vessel 18 which has its floor F located sufficiently close to the hull 16H of the vessel 18. Such modification to an existing vessel hull 16H also minimizes the loss of buoyancy as well as the extent of modification required of such hull. A further benefit, when the slope (or angle) of the pod drive platform 24 is less than the local hull deadrise, is that the pod drive platforms 24 act as a surface to increase hydrodynamic transverse stability which is desirable when the pod drives are not mounted on a horizontal plane.

B. General Description of Hull Configurations for Pod Platforms

Figure 7E:
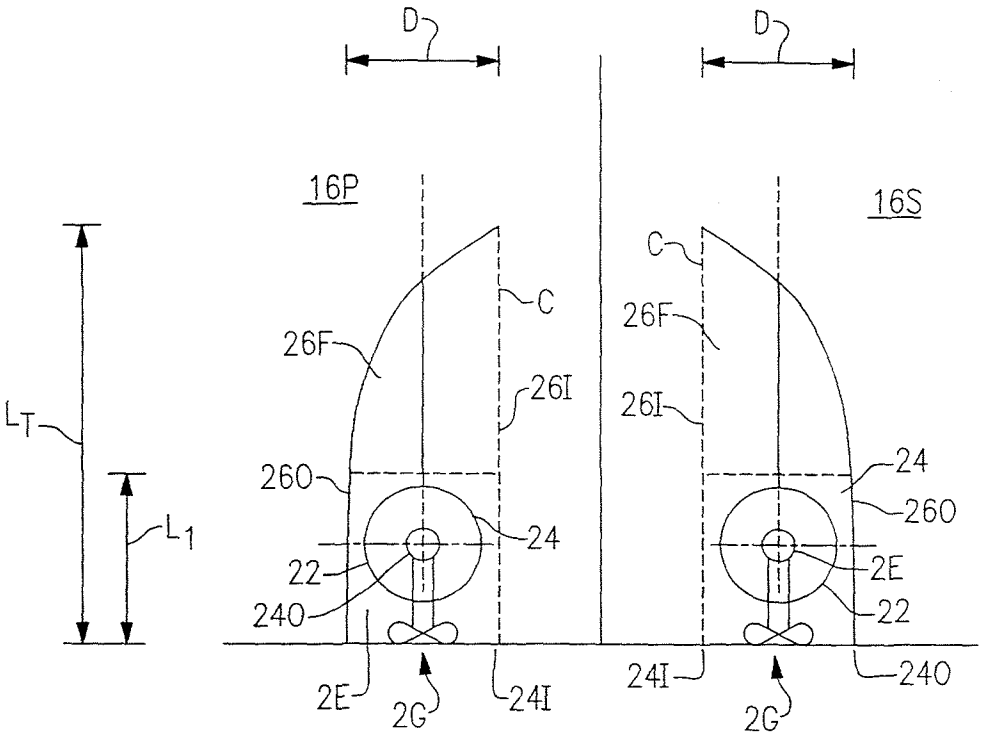
Figure 7F:
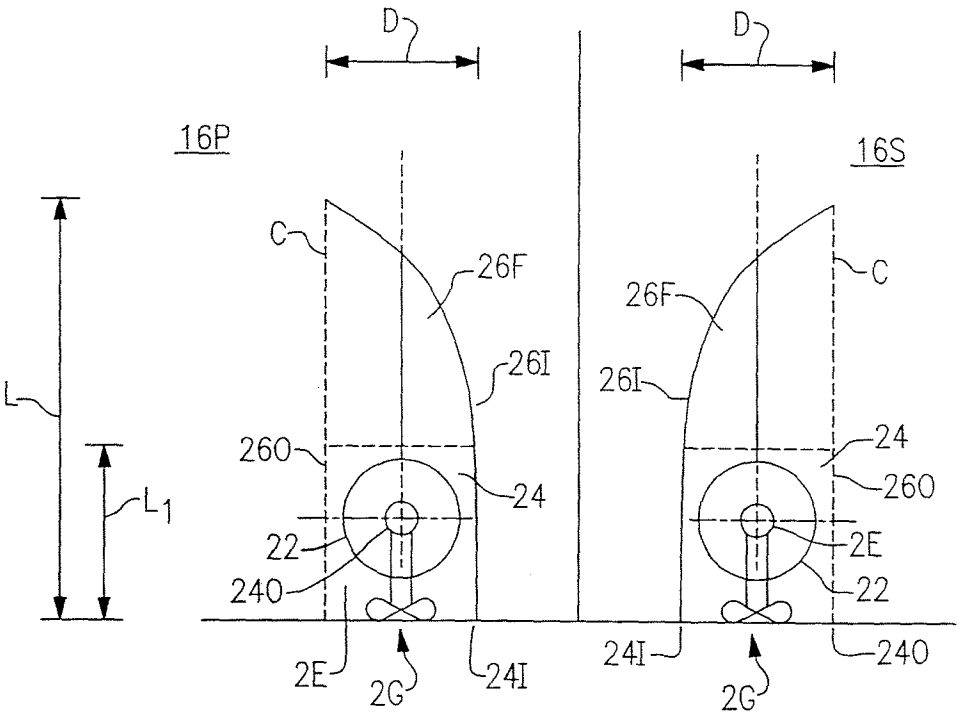

FIGS. 7B, 7E and 7F are, in turn, diagrammatic bottom plan views illustrating the general configurations and relationships of inboard and outboard sidewalls 26I and 26O and the contours of the port and starboard bull bottom surfaces. As illustrated in those Figures, either or both of the inboard and the outboard side walls 26I and 26O form a fairing 26F integrating the pod drive platform 24 into the contours of the bottom hull surfaces 16P and 16S to allow for the optimum flow of water over the exterior bottom surfaces 16P and 16S of the hull 16H and the pod drive platforms 24, depending upon the position of pod drive platform 24 along the width of the port and the starboard bottom hull surfaces 16P and 16S. In this regard, it will be noted that the aft end of pod drive platform 24 and the inboard and the outboard sidewalls 26I and 26O will, in each case, be generally terminated by the plane of the transom of hull 16H, the general manner of the exemplary implementations of the pod drive systems is illustrated, for example, in FIGS. 2 through 6. The adaptation of pod drive systems and the pod drive platforms of the present invention, to hulls having rounded or curved bottoms, will be well understood by and be apparent to those of ordinary skill in the relevant arts.

As shown in FIGS. 7G-7K, each pod drive platform 24 has a horizontal width D along the platform dimension which extends perpendicular to the keel 16K, that is across hull 16H, such that the width D is at least equal to or greater than the diameter of rotational pod mount 22 to be installed and is sufficient to at least accommodate and support a rotating steerable gearcase (not shown) and associated steering and drive elements of the pod drive unit 12. Each pod drive platform 24 has a horizontal length $L_1$, along the platform dimension, which extends parallel to the keel 16K which is longitudinal along the longitudinal length of the keel 16K of the hull 16H, wherein the length $L_1$ is equal to or greater than the length diameter of the rotational pod mount to be installed and is sufficient to at least accommodate and support rotating steerable gearcase and associated steering and drive elements of the pod drive unit 12 such that the exterior surface of the pod drive unit 12 is flush with the bottom surface of the vessel 18. The total length $L_T$ of the recess or cut out for the pod drive platform 24 is also sufficient to facilitate fairing the pod drive platform 24 into the port and the starboard bottom hull surfaces 16P and 16S of the hull 16H, as described herein.

Figure 7I:
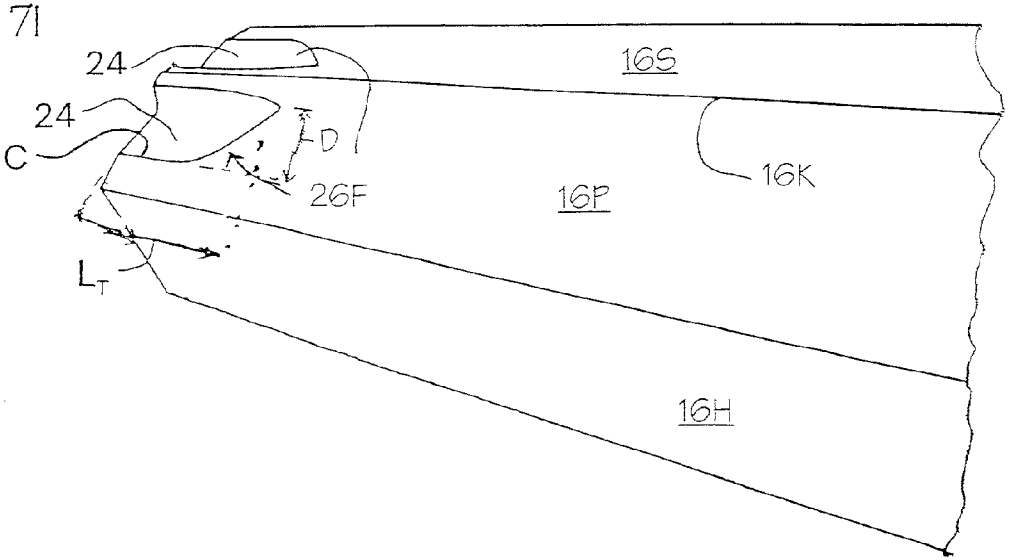
Figure 7H:
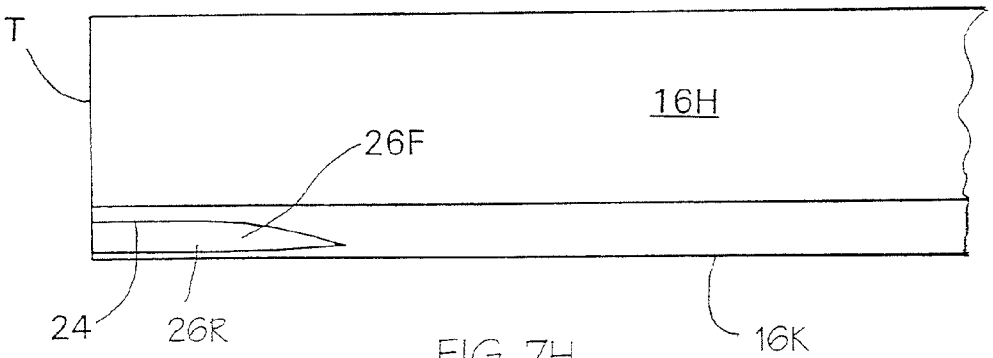
Figure 7G:
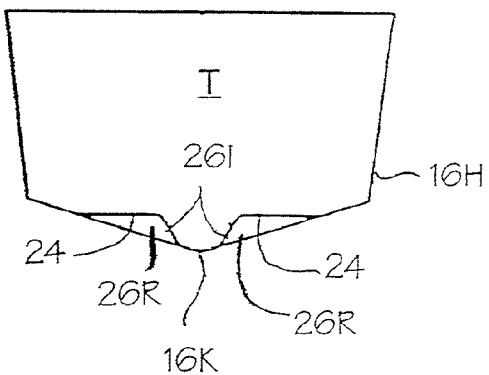
Figure 7J:
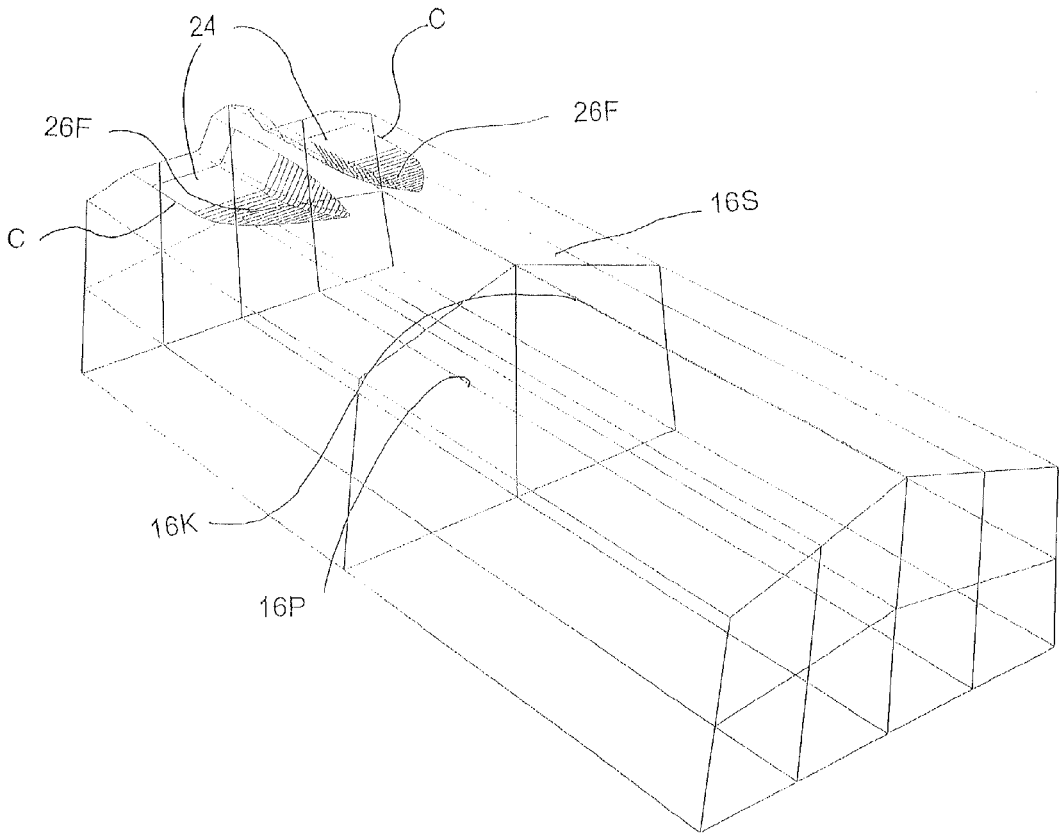
FIGS. 7J and 7K are both bottom perspective views of this embodiment.
Figure 7K:
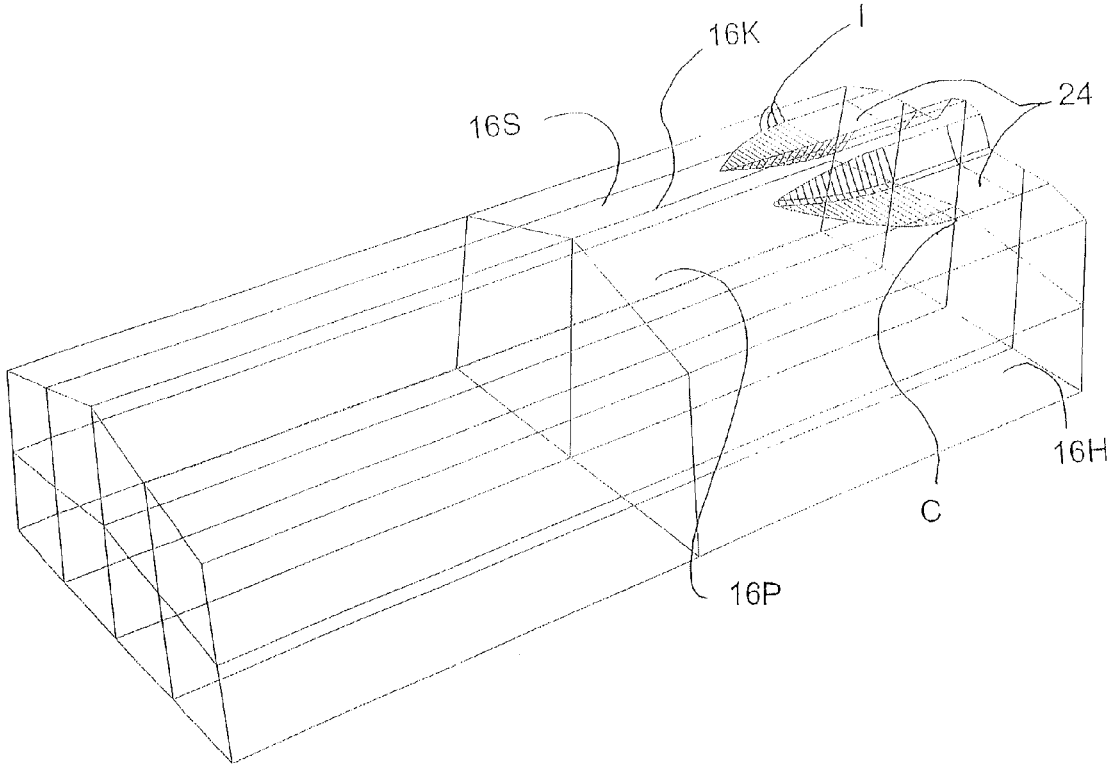

According to is embodiment, each pod drive platform 24 is positioned along the width of a corresponding one of the port hull surface 16P and the starboard hull surface 16S so that the horizontal plane, formed by the pod drive platform 24, intersects an inclined plane P, generally formed and defined by a corresponding one of the port bottom hull surface 16P and the starboard bottom hull surface 16S. As shown in FIGS. 7I, 7J and 7K, the contour of intersection C, between the pod drive platform 24 and the corresponding one of the port hull surface 16P and the starboard hull surface 16S is generally a curved edge.

As can be seen from FIGS. 7G-7K, the relationship of the pod drive platform 24, relative to the port and the starboard bottom hull surfaces 16P and 16S, will result in the pod drive platform 24 mating or joining with the respective port and the starboard bottom hull surfaces 16P and 16S so as to form a wedge shaped inboard recess 26R relative to the port and the starboard hull surfaces 16P and 16S. The perimeter of the pod drive platform 24, both along the leading bow end thereof and along the outer port or outer starboard side of the pod drive platform 24, has a smooth and gradual transition or fairing with the port or the starboard bottom hull surfaces 16P and 16S of the vessel 18. The perimeter of the pod drive platform 24, adjacent the keel 16K of the vessel 18, generally has a more abrupt transition with the bottom hull surfaces 16P and 16S of the vessel 18. That is, an angle of between 90 and 150, typically about 120 degrees or so, is formed between the pod drive platform 24 and the inboard sidewall 26I (see FIG. 7G).

As noted above and illustrated in FIGS. 7H-7K, the outboard perimeter edge of the pod drive platform 24 forms a fairing 26F which smoothly integrates the exposed, exterior surface of the pod drive unit 12, following installation thereof, with the bottom hull surfaces 16P and 16S so as to allow for the optimum flow of water over the exterior bottom surfaces 16P and 16S of the hull 16H and exterior surface of the pod drive unit 12. In many applications, the pod drive platform 24 may be recessed further into the hull of the vessel 18 to ensure that the exterior surface of the pod drive unit 12, following installation thereof, precisely merges with and forms an exterior contour for the vessel 18 which results in the desired water flow characteristics along the bottom of the vessel 18 with minimal drag. In this regard, it will be noted that the aft end of the pod drive platform 24 and the inboard sidewalls 26I will, in each case, be generally terminated by the plane of the transom T of hull 16H, general in the manner illustrated in FIGS. 2 through 6, for example.

Figure 7L:
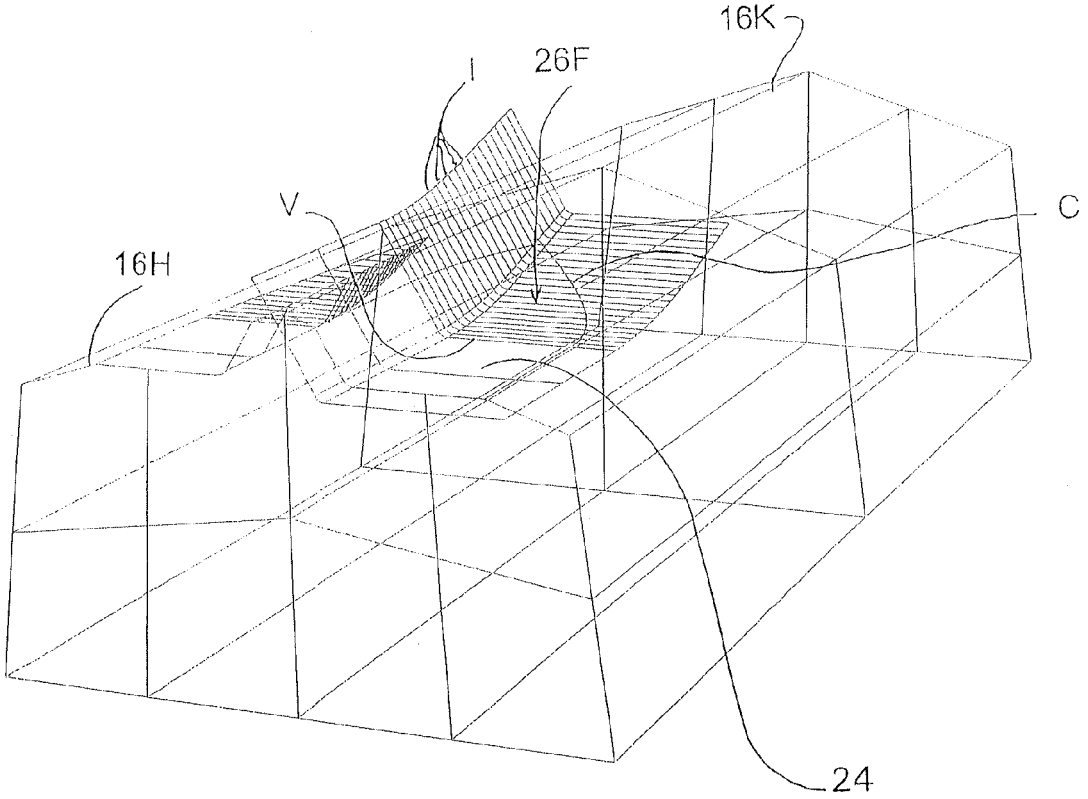
FIG. 7L is diagrammatic view showing how a perimeter of the cut-out section, for dual pod drive system, according to the present invention for a V-bottom hull, is determined for either an existing or a new hull design.

To determine the precise profile of the cut-out to be formed within the hull (either for retrofitting an existing hull or designing a new hull) according to this embodiment, the overall shape of the cut-out is developed using a V-shaped angled section V (comprising a horizontal leg and an inclined leg) for creating the wedge shaped cut-out in the hull 16H (see FIG. 7L). Generally the V-shaped angled section V is passed through the hull of the vessel 18 to determine the overall perimeter of the cut-out to be formed within the hull 16H. It is to be appreciated that while passing the V-shaped angled section V through the hull, the orientation of the V-shaped angled section V, relative to the hull 16H, does not change, i.e., the V-shaped angled section is merely gradually moved vertically away from the hull as the V-shaped angled section V is moved from the stern toward the bow of the vessel 18. That is, the orientation of the V-shaped angled section V, relative to the hull, always remains constant so that horizontal leg always remains in a horizontal orientation. The associated incremental transitions I, determined by the V-shaped angled section V, can be seen in FIG. 7L.

In order to form of the pod drive platform 24, the V-shaped angled section initially passes longitudinally along the hull 16H, from the stern toward the bow, generally without any vertical movement of the V-shaped angled section V away from the hull 16H for a sufficient distance, at least equal to the desired longitudinal length of the horizontal pod drive platform 24, to form a horizontal and flat surface for accommodating the pod drive unit. Thereafter, the V-shaped angled section V commences its gradual vertical incremental transition away from the hull, e.g., for each small increment I that the V-shaped angled section V moves longitudinally toward the bow of the vessel 18, the V-shaped angled section V is also gradually moved vertically incrementally I away from the hull 16H and these incremental transitions I are diagrammatically shown in FIG. 7L. The incremental transitions I are spaced quite close to one another, adjacent a leading bow end of the cutout, but are spaced slightly further away from one another adjacent the stern end of the vessel 18.

Although the incremental transitions I are shown generally equal to one another in FIG. 7L toward the bow end, it is to be appreciated that the incremental transitions I may depend upon the particular application. As noted above, the cut-out is designed so as to form a flat region or area, which may included a shouldered radii, and allow the pod drive unit 12 to mounted in a flush fashion within this recess so that the exterior surface of the pod drive unit 12 merges with and forms a smooth transition with the exterior surface of the hull to provide the desired efficient water flow characteristics along the bottom surface of the vessel 18, as generally shown in FIG. 14.

It is to be appreciated that the desired depth and/or offset of the V-shaped angled section V may be altered due to the deadrise angle and/or twist of the hull. Moreover, for some applications, the V-shaped angled section V may be shifted or moved forward, toward the bow of the vessel 18, to provide a longer straight section, i.e., a longer horizontal pod drive platform 24, adjacent the transom of the vessel 18. A longer straight section, or a longer pod drive platform 24, is generally required when a drive, for the vessel 18, is shifted or moved forward for some reason, e.g., to avoid interfering with a raked transom or a hydraulic swim platform. Such shift toward the bow, and away from the transom of the vessel 18, is generally on the order of between about 45.7 to 76.2 cm (18 to 30 inches).

C. Detailed Descriptions of Presently Preferred Embodiments of Hull Configurations for Pod Platforms Referring to FIGS. 8A, 9A-9G, 10A-10G and 11A-11G and to FIGS. 12A and 13A-13G, therein are shown a diagrammatic illustrations of additional embodiments of hull configurations for the mounting of pod platforms of pod drive systems to minimize disadvantageous effects on the hull such as, for example, an undesirable reduction in or distribution of buoyancy or trim of the hull, an excessive wetted surface area and consequent drag of the hull, undesirable fluid flow paths around the hull that, for example, result in undesirable low or high pressure areas in the aft regions of the hull, and undesirable handling characteristics.

Triangular Hull Configuration

Referring first to FIG. 8A and FIGS. 10A-10G, a "delta" hull configuration 28, for mounting two separate spaced apart pod drive units (not shown in these Figures), generally one on either side of the keel 16K of a vessel 18, is illustrated. As shown therein, the triangular hull configuration 28 includes a pair of generally planar horizontal pod drive mounting platforms 24 that each extend, by a width W, normal to the keel 16K and extend longitudinally along the keel 16K, by a distance L, where width W and length L are at least adequate in size so as to form first and second pod drive platforms 24A and 24B, located on either side of keel 16K, for mounting of the pod drive units 2A at the desired locations on either side of keel 16K. The first and the second pod drive platforms 24A and 24B are coincident with one another and define a pod drive mounting plane 24P. An aft edge of the pod drive mounting plane 24P, and thus of the pod drive platforms 24A and 24B, is generally located at the aft end of the hull 16H while a forward end of drive mounting plane 24P, and thus of the pod drive platforms 24A and 24B, is a located along a fairing inflection line 26FL that extends generally perpendicular to the keel 16K and comprises the start of a generally planar triangular fairing 26FD.

Figure 8A:
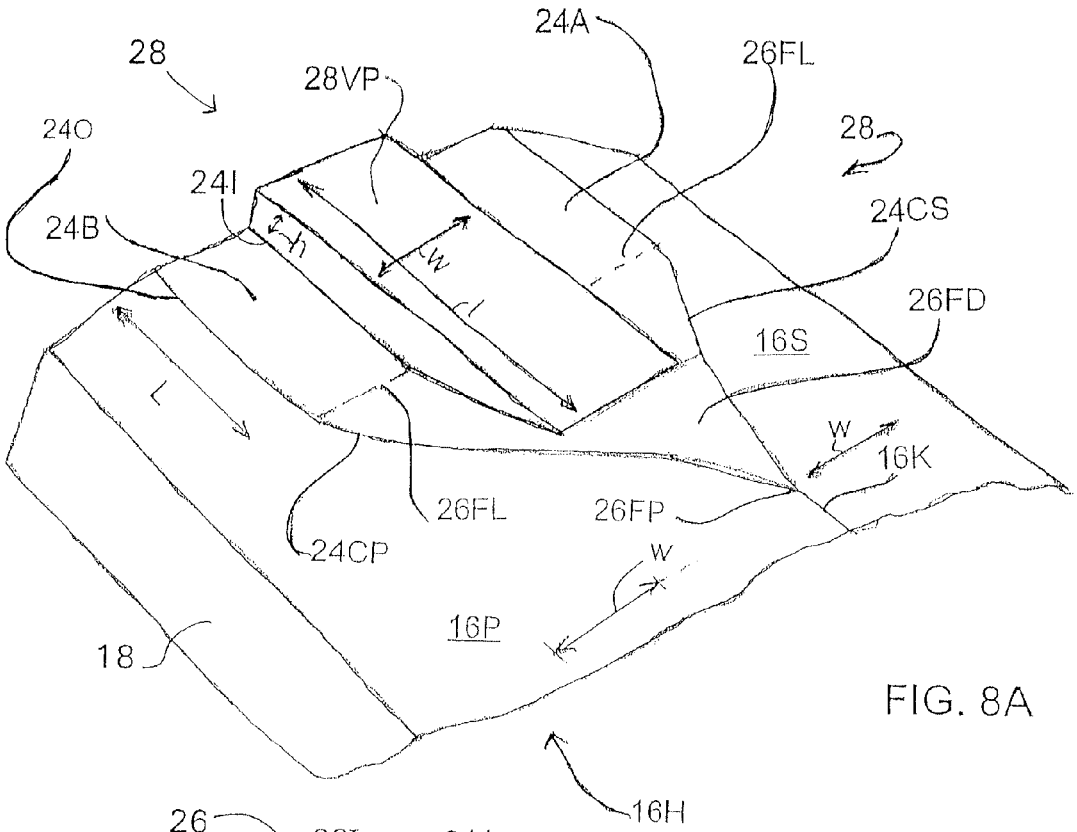
FIGS. 8A, 9A-9G, 10A-10G and 11A-11G are diagrammatic illustrations of presently preferred embodiments of hull configurations adapted for mounting pod platforms and pod drive units for a "delta" hull configuration.

According to the triangular hull configuration 28, the triangular fairing 26FD forms a generally triangular, or delta, shaped planar surface which extends forward toward the bow end of the vessel 18 and downward from the fairing inflection line 26FL, located at the forward end of the pod drive platform 24, and the triangular fairing 26FD gradually narrows or tapers toward a triangular fairing intersection point 26FP with the keel 16K. The slope or slant of triangular fairing 26FD, from fairing inflection line 26FL to the intersection point 26FP, is defined as "downward" with respect to the hull 16H when the hull is orientated in its normal upright position so that the vessel 18 is able to navigate water. It will be noted that the slant of the triangular fairing 26FD, as illustrated in FIG. 8A, for example, is upward from the fairing inflection line 26FL toward the triangular fairing intersection point 26FP because the hull 16H, in this Figure, is shown in an upside down, inverted position. In a presently preferred embodiment of the triangular hull configuration 28, a forward and downward slant angle of about 7 degrees ±4 degrees is formed between the keel 16K of the vessel 18 and the triangular fairing 26FD.

As also generally shown in the present preferred embodiment illustrated in FIGS. 8A, 10A-G and 11A-11G, the triangular fairing 26FD is a doubly curved surface having a downwardly concave transversely extending arc located toward the aft section of the triangular fairing 26FD, which provides a smooth hydrodynamic transition or fillet between the first and the second pod drive platforms 24A and 24B and a trailing, rear edge of the triangular fairing 26FD, and an upwardly convex transversely extending arc toward the leading, front section of the triangular fairing 26FD, which provides a smooth hydrodynamic transition or fillet between the triangular fairing 26FD and the port and the starboard sides of the hull 16H, wherein downwardly and upwardly are defined with respect to the hull 16H in the upright position, and with the triangular fairing 26FD being tangent with the plane of the pod drive mounting plane 24P, at the fairing inflection line 26FL, and with the plane of the keel 16K, at the triangular fairing intersection point 26FP.

As shown generally in FIG. 8A, the first and the second pod drive platforms 24A and 24B and the triangular fairing 26FD together have port and starboard outer boundary contours 24CP and 24CS that are formed by the intersection of either the first or the second pod drive platform 24A and 24B and the triangular fairing 26FD with the respective port and starboard bottom hull surfaces 16P and 16S of the hull 16H. As such, the first and the second pod drive platforms 24A and 24B and the triangular fairing 26FD do not have any outboard sidewalls or other abrupt transition(s) at the intersections of either the first or the second pod drive platforms 24A and 24B or the triangular fairing 26FD with the port and the starboard bottom hull surfaces 16P and 16F. That is, the entire outboard longitudinal edge of each of the first and the second pod drive platforms 24A and 24B and the triangular fairing 26FD has a rounded smooth hydrodynamic transition with a remainder of the bottom hull surfaces 16P and 16S to minimize any drag of the vessel 18.

As shown in FIGS. 9A-9G, it is to be appreciated that a triangular hull configuration 28 may be employed in cases where the hull 16H only mounts a single pod drive unit on a single centrally located pod drive platform 24 (without any volume/planing structure), such as for a vessel having multiple hulls, e.g., a catamaran or a trimaran vessel having two or three hulls, or for a single hull vessel having a centrally located pod drive platform 24, wherein each hull may mount a single pod drive unit on a single pod drive platform 24. In such cases, the single pod drive platform will be mounted along the keel 16K centerline of the hull 16H, rather than to one side or the other of the centerline of the keel 16K. It is to be appreciated that the mounting of the single pod drive unit 12 to the single pod drive platform 24 is the same as described above with respect to the previous embodiments.

According to alternate embodiments of vessel with the triangular hull configuration 28 and multiple pod drive units, as illustrated in FIGS. 8A and 10A-10G, the triangular hull configuration 28 may further include an additional volume/planing structure 28VP which provides the bottom surface of the vessel 18, at least at the aft end of the hull 16H, with additional buoyancy and/or an addition planing support surface. As illustrated therein, the volume/planing structure 28VP is generally centered axially along the keel 16K and has width w that extends across the pod drive mounting plane 24P, between inside boundaries 24I of the first and the second pod drive platforms 24A and 24B, and a length l that extends generally along the axis defined by the keel 16K from the aft end of the pod drive mounting plane 24P to a location where the volume/planing structure 28VP merges with the triangular fairing 26FD, at a desired location generally between the fairing inflection line 26FL and the triangular fairing intersection point 26FP.

Figure 10B:
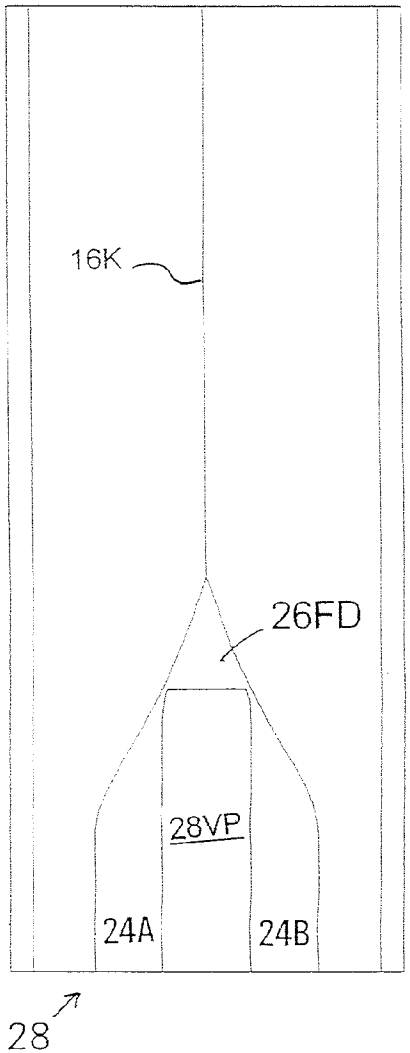
Figure 10A:
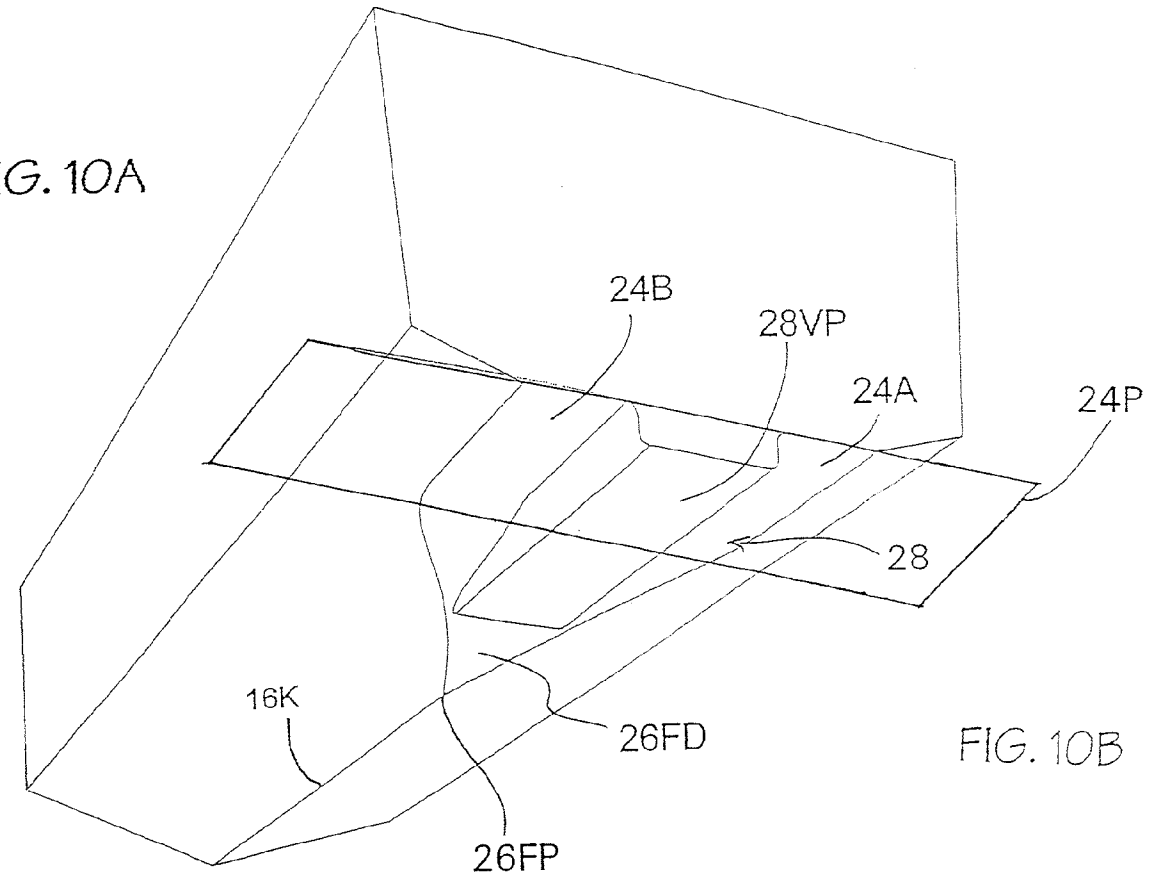
Figure 10C:
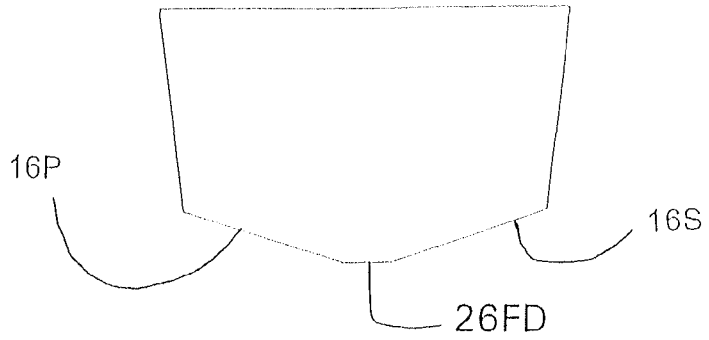
Figure 10D:
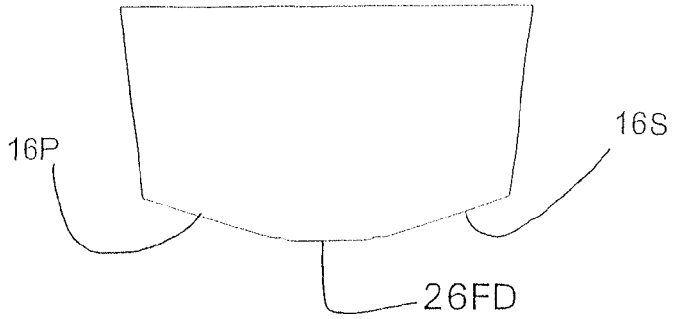
Figure 10E:
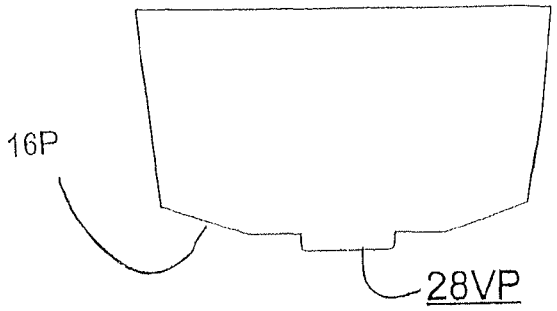
Figure 10F:
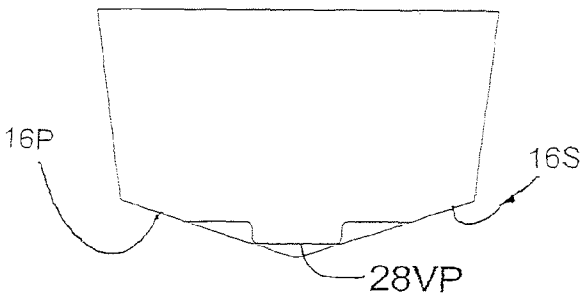
Figure 10G:
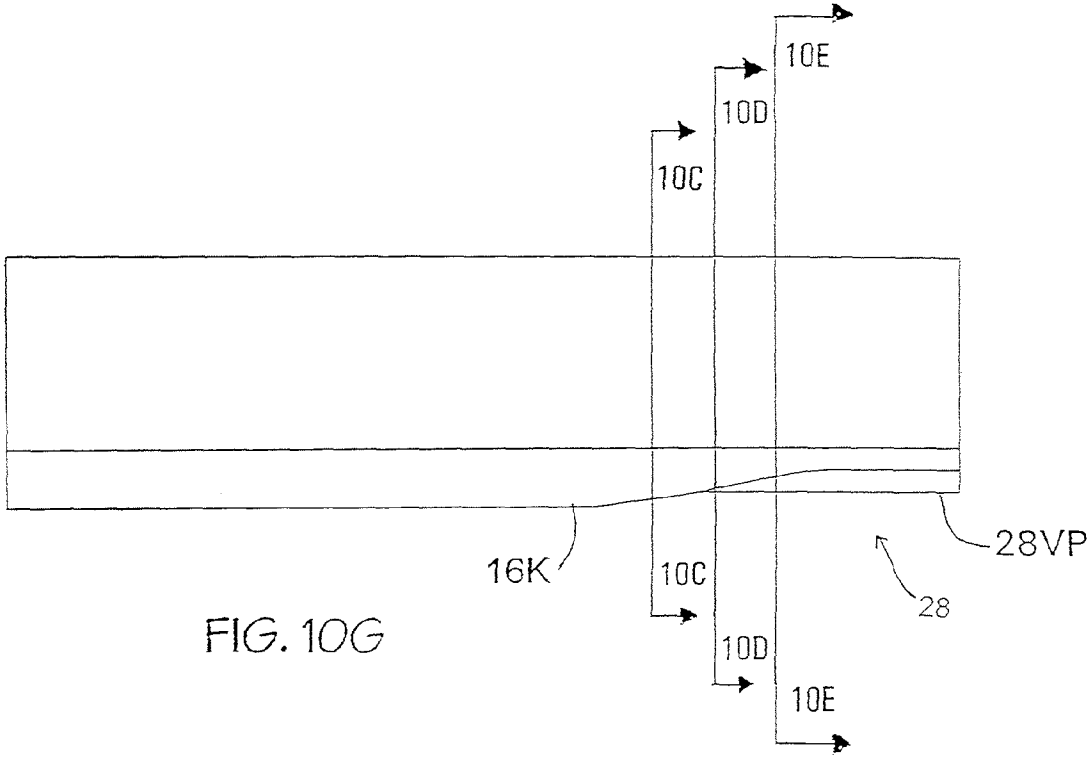

The height h of the volume/planing structure 28VP, relative to pod drive mounting plane 24P, as shown in FIGS. 10A, 10F and 10G, for example, dictates the amount of additional buoyancy and/or addition planing support that the volume/planing structure 28V provides and the height is typically less than the height that the keel 16K projects with respect to the pod drive mounting plane 24P at the aft end of pod drive mounting plane 24P. The leading, forward edge of the volume/planing structure 28VP fairs into or has a smooth hydrodynamic transition or fillet with the triangular fairing 26FD, thereby again allowing for a smooth flow of water along the exterior of the bottom hull surfaces 16P and 16S, the surfaces of the first and the second pod drive platforms 24A and 24B, the triangular fairing 26FD and the volume/planing structure 28VP so as to minimize drag and other adverse effects for the vessel 18.

It will be noted, in particular with respect to the triangular hull configurations 28 illustrated in FIGS. 8A, 9A-9G, 10A-10G and 11A-11G, that the triangular hull configuration 28 does not include any form of a "tunnel" or a "channel", thus avoiding the problems and disadvantages associated with having a tunnel(s) or a channel(s) incorporated into the hull which occurs with some prior art configurations. It should also be noted, however, that the upward slant of the triangular fairing 26FD, from the leading triangular fairing intersection point 26FP to the trailing fairing inflection line 26FL, located at the forward edge of the pod platform or platforms 24A and 24B, causes the pod drive units 12 to be "recessed" somewhat upward, with respect to the keel 16K of the vessel 18, and thereby recessed with respect to the port and the starboard bottom hull surfaces 16P and 16S of the hull 16H. Such "recessing" of the pod drive units 12, with respect to the bottom surfaces 16P and 16S and the keel 16K of the vessel 18, thereby providing pod drive units 12 and the propellers 2G, in particular, with at least some degree of protection similar to that provided by recessing the pod drive units 12 within a "channel" or a "tunnel", as with the prior art, but without the adverse disadvantages of the "channel" or the "tunnel" configuration.

Figure 11B:
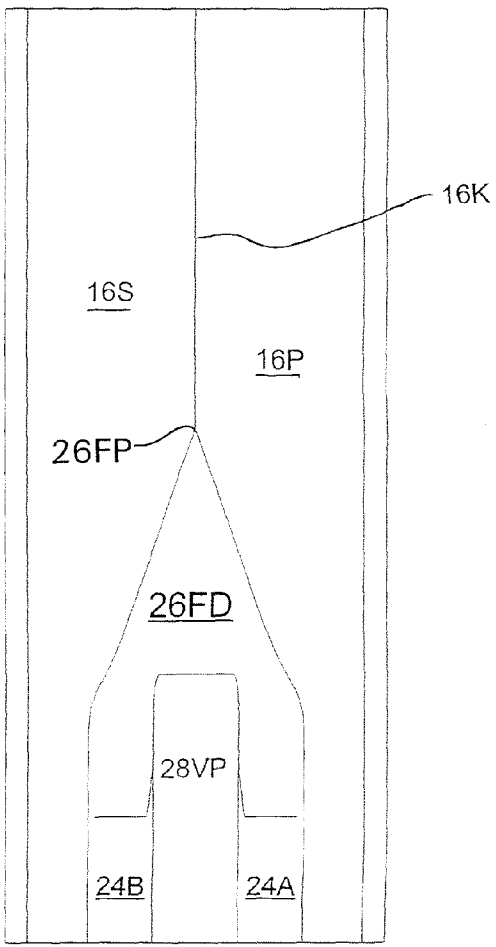
Figure 11A:
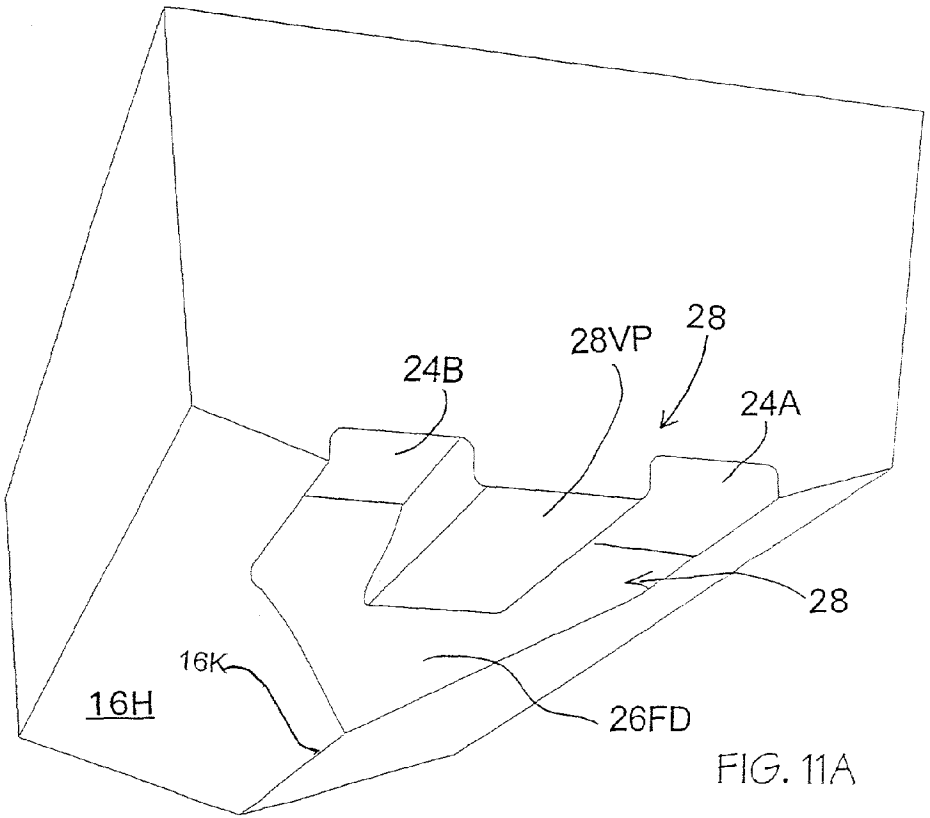
Figure 11C:
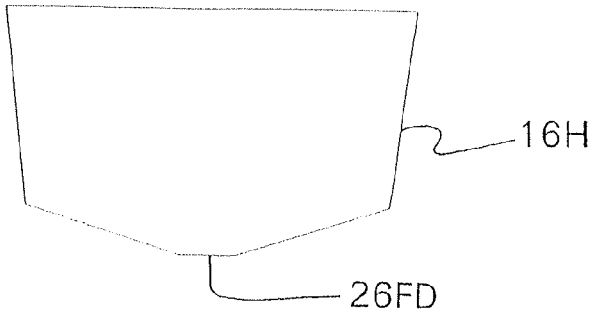
Figure 11D:
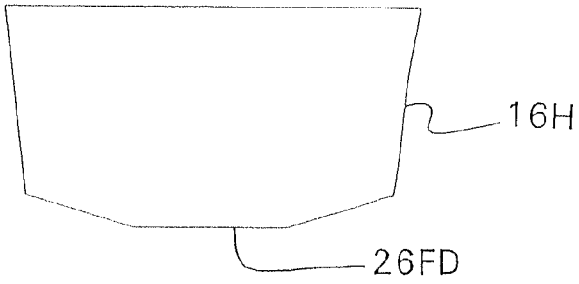
Figure 11E:
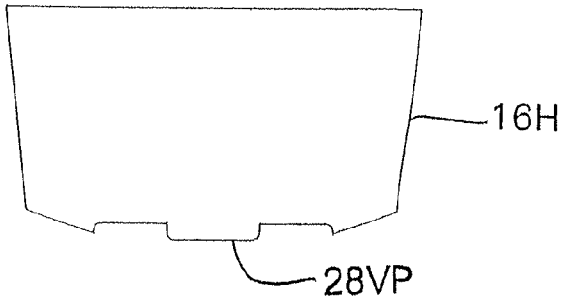
Figure 11F:
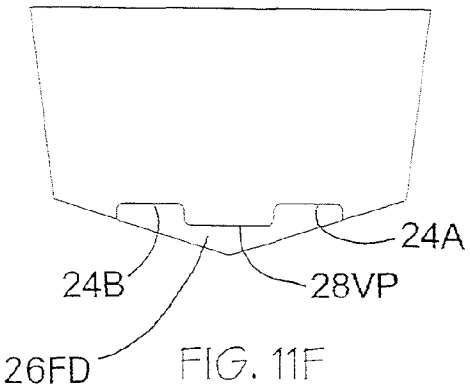
Figure 11G:
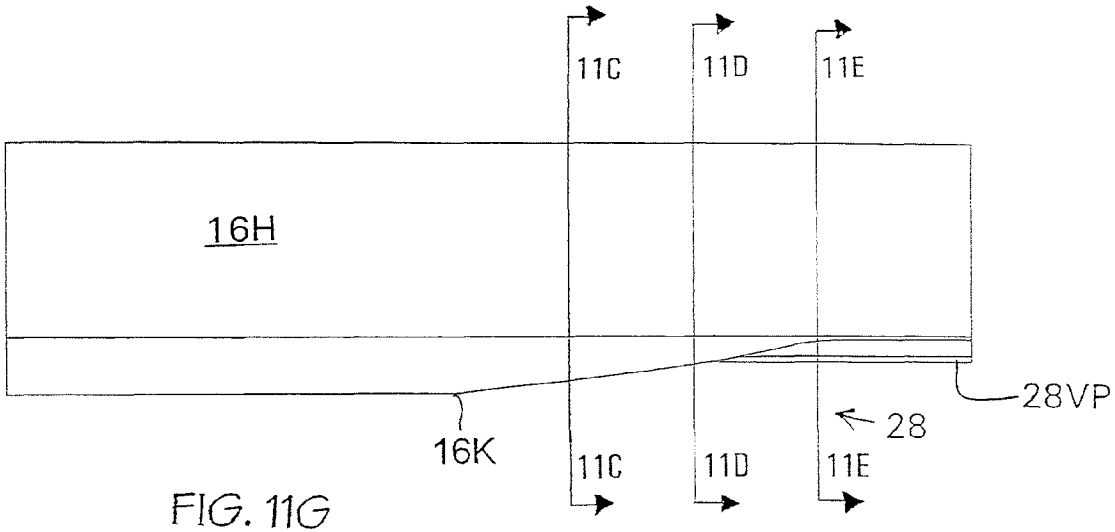
Figure 13B:
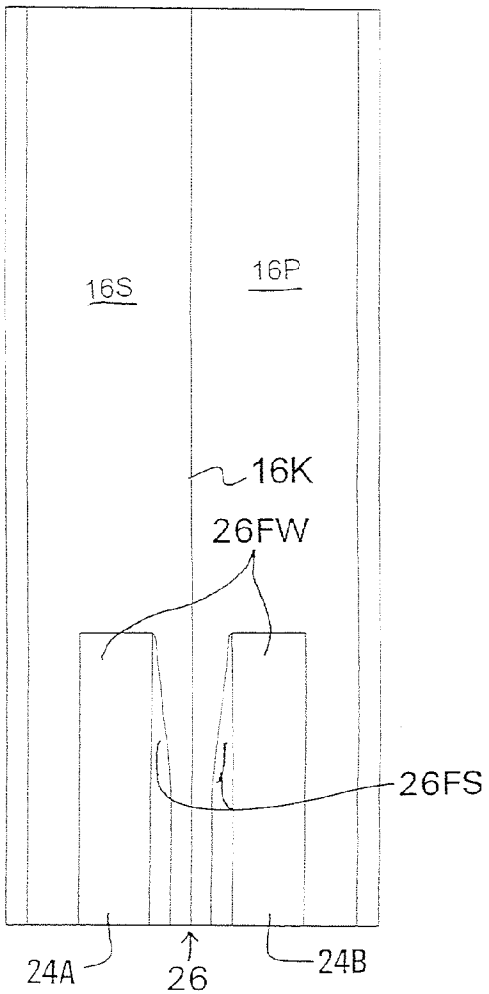
Figure 13A:
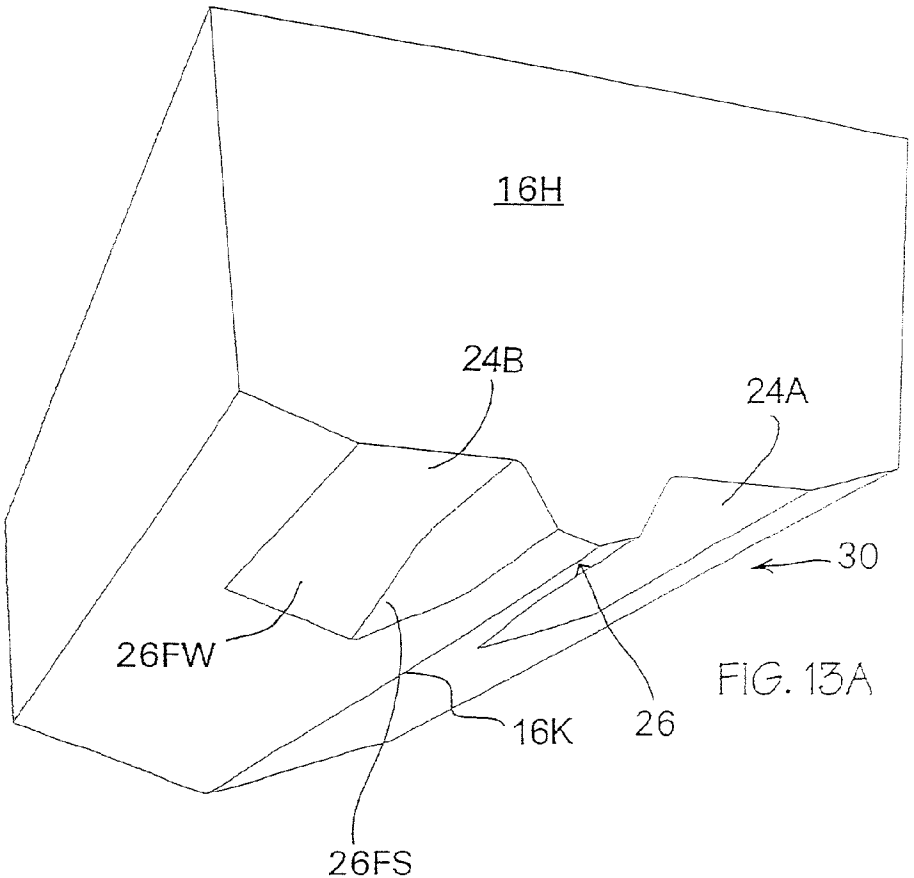
Figure 13C:
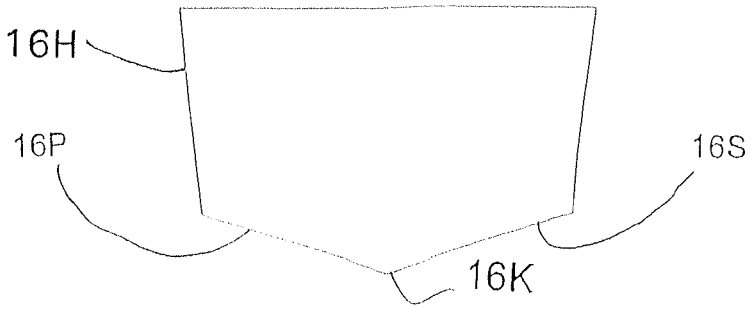
Figure 13D:
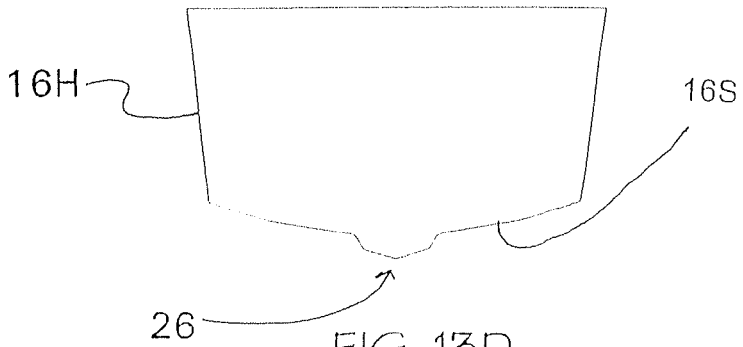
Figure 13E:
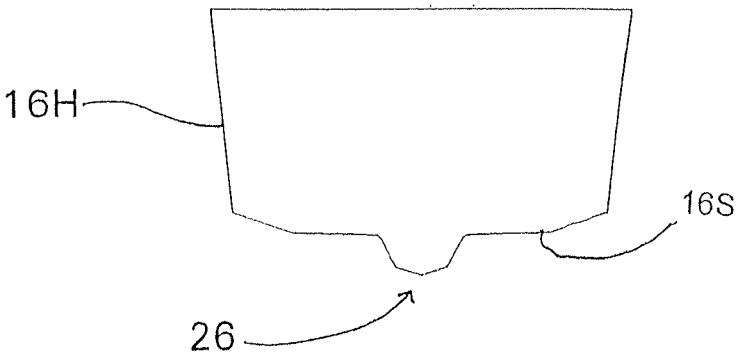
Figure 13F:
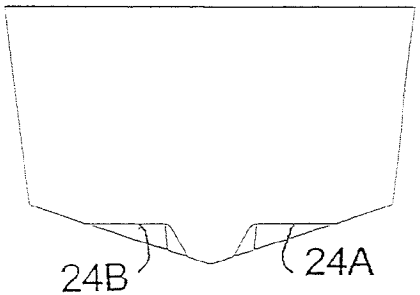
Figure 13G:
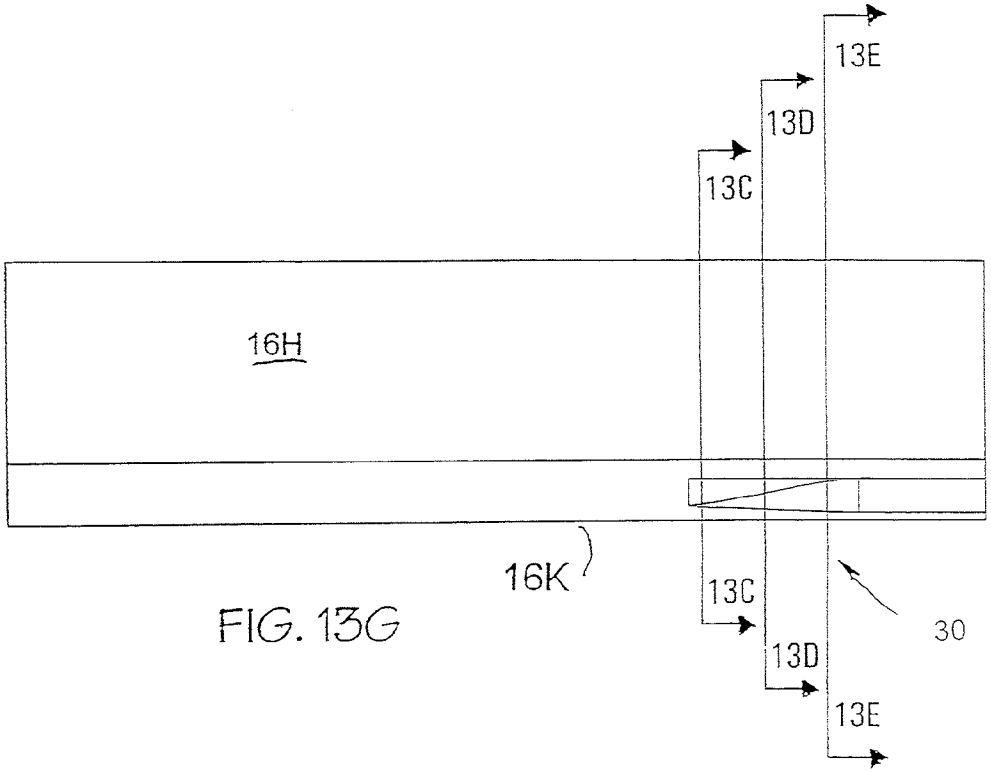

In a yet further alternate embodiment of the triangular hull configuration 28, as illustrated in FIGS. 11A-11G, the pod drive platform 24 or the pod drive platforms 24 may be offset vertically upward, relative to the port and the starboard bottom hull surfaces 16P and 16S of the hull 16H, in comparison to the positions shown in FIGS. 7A, 7C and 7D, 8A, 9A-9G and 10A-10G, without deviating from the above described principles of the present invention. That is, the first and the second pod drive platforms 24A and 24B are recessed further, relative to the keel 16K and the port and the starboard hulls 16P, 16S of the vessel 18 to provide further protection. As a result of such arrangement, the triangular fairing intersection point 26FP is normally located further away from the stern and closer to the bow end of the vessel 18. Since the inclination angle of the triangular fairing 26FD generally remains the same, e.g., about 7 degrees ±4 degrees, typically the length of the triangular fairing 26FD is increased, as can be seen in FIGS. 11B and 11G, to permit a gradual fairing of the first and the second pod drive platforms 24A and 24B with the bottom port and the starboard hull surfaces 16P and 16S of the vessel 18. Since the first and the second pod drive platforms 24A and 24B are recessed further relative to the vessel, this in turn reduces the amount that the respective pod drive unit 12 may be required to be recessed within the pod drive platform 24 while still providing the pod drive unit 12 and associated propeller 2G with additional protection so that the "tunneling" and "channeling" effects, described with respect to FIGS. 1, 3 and 5, for example, are significantly reduced and/or possibly eliminated. As described previously, such additional recessing of the pod drive units 12 and the pod drive platforms 24 may be necessary or desirable for a number of reasons, such as an adaptation to the internal structures of the hull or to reduce the protrusion of elements of the pod drive unit, such as steerable gearcase 2E, into the water flow paths in the region of the pod drive system 2 with consequent unwanted disturbances in the water flow around the hull and the pod drive units in this region.

It is to be appreciated that substantially the entire surface of the triangular fairing and substantially the entire surface of each one of the port and the starboard pod drive platforms are each substantially planar surfaces which gradually merger with one another or with any adjacent intersecting surface of the bottom of the vessel, via a rounded surface(s) or edge(s) so as to provide a substantially hydrodynamic contour for the bottom surface of the vessel which minimizes drag.

Curved Hull Configuration

Turning now to FIGS. 12A and 13A-13G, a "warp" hull configuration 30 is illustrated therein for mounting two pod drive units (not shown in the Figure) on first and second pod drive platforms 24A and 24B, with one pod drive units 12 being mounted on each side of the keel 16K of the vessel 18. As shown in FIGS. 12A and 13A-13G, the overall configuration of a curved hull configuration and the first and the second pod drive platforms 24A and 24B, for mount pod drive units 12 thereon, is generally similar to the configuration illustrated herein above with respect to FIG. 7D, but with some differences with respect to the fairings 26F by which the first and the second pod drive platforms 24A and 24B are faired into bottom port and starboard hull surfaces 16P and 16S.

Referring therefore to FIGS. 7I, 12A and 13A-13G, each of the first and the second pod drive platforms 24A and 24B has a horizontal width D along the platform which extends generally perpendicular to the keel 16K, that is transversely across the hull 16H, such that the width D is at least equal to or slightly greater than a width dimension of the rotational pod mount 22 and is of a sufficient size so as to at least accommodate and support a desired rotating steerable gearcase 2E and the associated steering and drive elements of the pod drive unit 12. Each of the first and the second pod drive platforms 24 has a horizontal length L or $L_T$, along the platform dimension which extends generally parallel to the keel 16K (see FIGS. 7I and 12A, for example), that is longitudinal along the longitudinal length of the hull 16H, wherein the length L or $L_T$ is equal to or greater than a length dimension of the rotational pod mount 22 so as to accommodate and support a rotating steerable gearcase 2E and the associated steering and drive elements of the pod drive unit 12 and also sufficient so as also to permit fairing of the pod drive platforms 24 respectively with the port and the starboard bottom hull surfaces 16P and 16S of the vessel 18, as described below in further detail.

According to the present invention, and as illustrated in FIGS. 7I-7H, 12A and 13A-13G, each pod drive platform 24 is positioned along the width of a corresponding one of the port hull surface 16P and the starboard hull surface 16S so that the horizontal plane, formed and defined by the first and the second pod drive platforms 24A and 24B, intersects an inclined plane P formed and defined by a corresponding one of the port bottom hull surface 16P and the starboard bottom hull surface 16S at a line at or adjacent to an outer boundary of the respective pod drive platform 24. As discussed previously, the contour of intersection C can be a straight line, a curved edge, a curved arc, a rounded or a curved segment, etc., depending upon the cross sectional shape of the hull 16H.

Figure 12A:
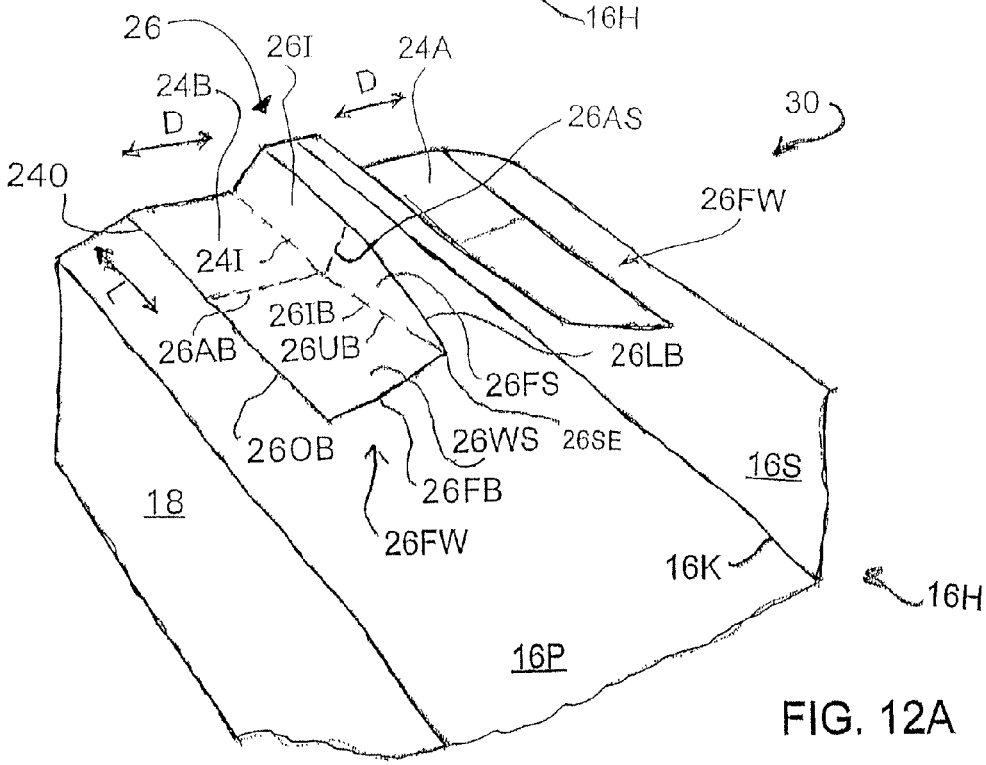
FIGS. 12A and 13A-13G are diagrammatic illustrations of presently preferred embodiments of hull configurations adapted for mounting pod platforms and pod drive units for a "warp" hull configuration.
Figure 9B:
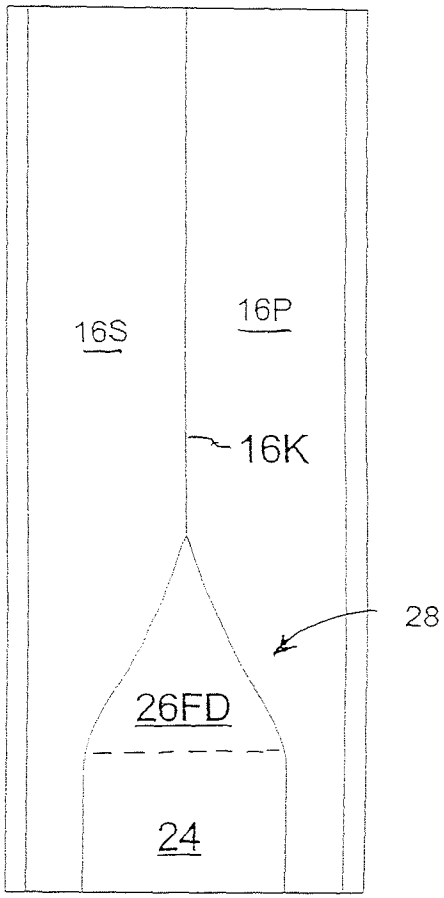
Figure 9A:
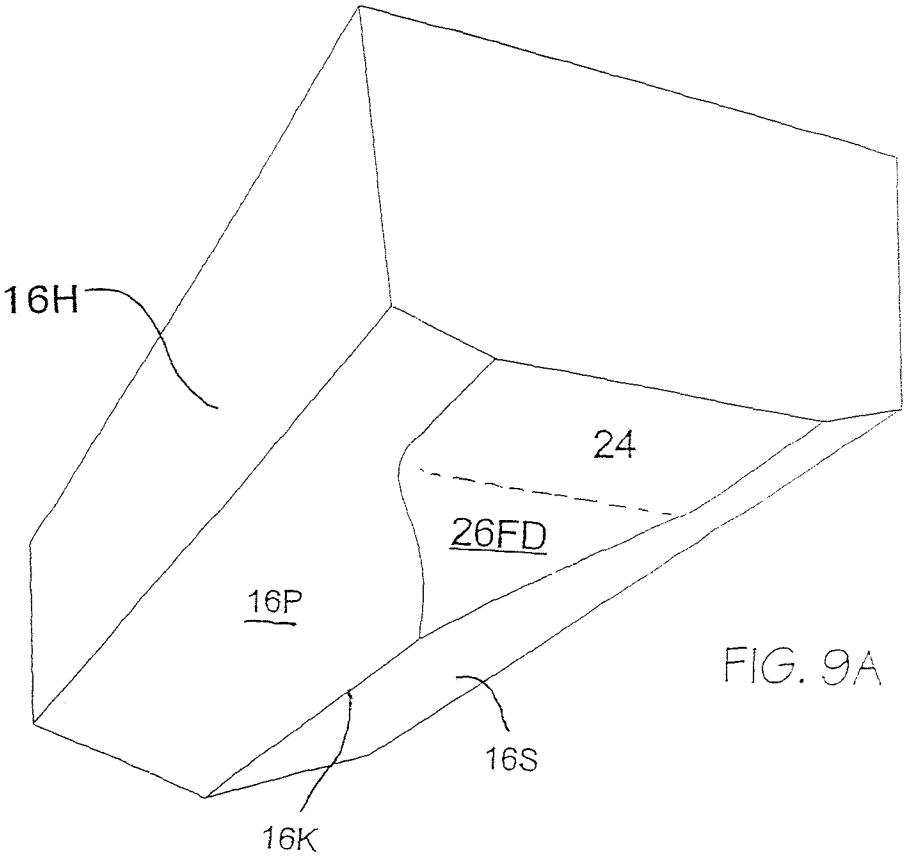
Figure 9C:
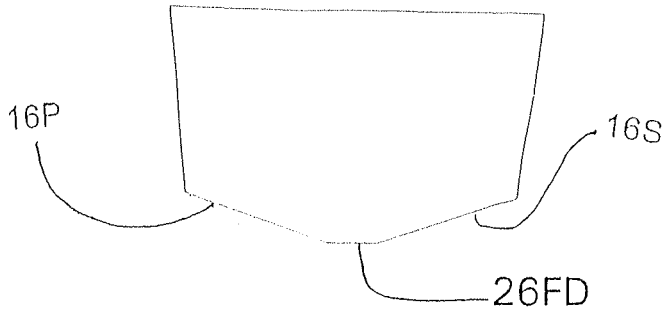
Figure 9D:
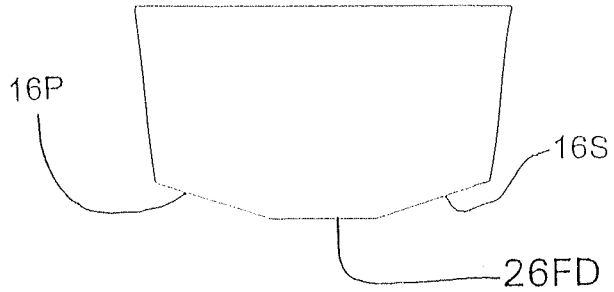
Figure 9E:
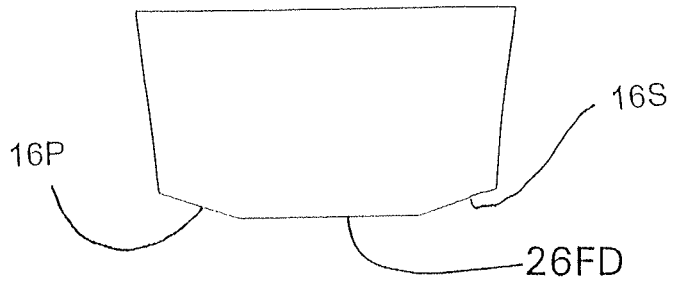
Figure 9F:
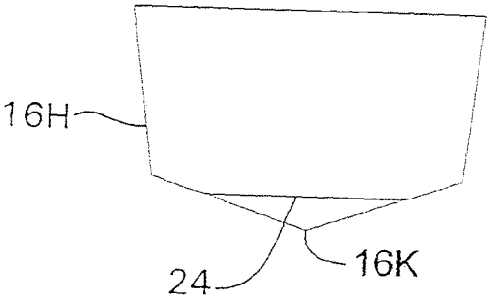
Figure 9G:
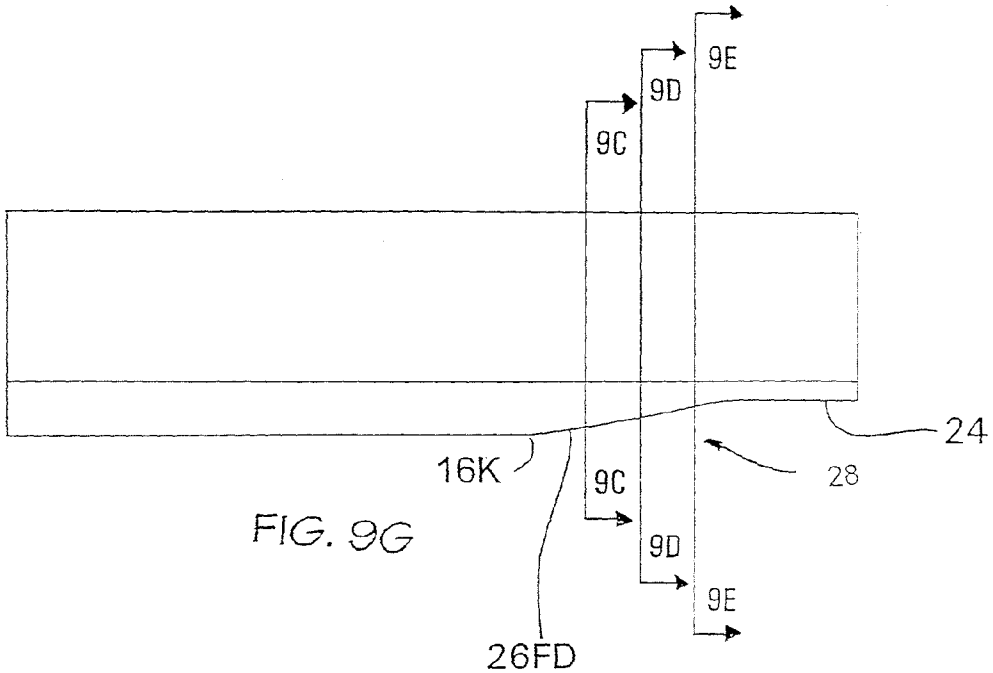

As shown in FIGS. 7I, 12A and 13A-13G, the relationship of the first and the second pod drive platforms 24A and 24B, relative to the port and the starboard bottom hull surfaces 16P and 16S, will result in each of the first and the second pod drive platforms 24A, 24B mating or joining with the corresponding port and the starboard bottom hull surface 16P or 16S by a wedge shaped inboard recess 26 formed between the pod drive platform 24 and the bottom hull surfaces 16P and 16S. As illustrated in FIG. 12A, the inside boundaries 24I of the first and the second pod drive platforms 24A and 24B form generally vertical inboard sidewalls 26I, between the horizontal plane of the pod drive platforms 24A and 24B and the port and the starboard hull surfaces 16P and 16S adjacent the keel 16K.

As discussed previously, an increase or a decrease in the hull volume and the wetted surface area of the hull, in the region of the pod drive unit or units, due to the mounting of the pod drive platform or platforms into the hull in this configuration, is significantly reduced as compared to the volume and the wetted surface area of the hull in this region for a bottom hull surface not including the hull drive pod platform or platforms. It will also be appreciated, again as discussed herein above, that the location or locations of the pod drive platform 24 or the pod drive platforms 24, relative to bottom hull surface 16P and 16S, may be displaced vertically by a relatively small amount, as compared to the positions shown in FIG. 7I, without deviating from the above described principles of the present invention where such modifications in the vertical position of the pod drive platforms 24 are minor compared to the vertical positions of systems of the prior art, as described with reference to FIGS. 1, 3 and 5, for example. As mentioned, such adaptations may be necessary or desirable for a number of reasons, such as an adaptation to internal structures of the hull or to reduce the protrusion of elements of a pod drive unit 12, such as the steerable gearcase 2E, into the water flow paths in the region of a pod drive system with consequent unwanted disturbances in the water flow around the hull and the pod drive units 12 in this region.

In a curved hull configuration 30, each pod drive platform 24 is faired into the port and the bottom surfaces 16P and 16S and the centerline of the keel 16K of the hull 16H by a curved fairing 26FW generally comprising two regions. A first region being a generally vertical and generally triangular sidewall fairing 26FS and the second region being a generally horizontal curved surface 26WS.

As illustrated in FIGS. 12A and 13A-13G, an upper boundary 26UB of the sidewall fairing 26FS, as defined with the hull 16H in the upright position, is defined by the intersection of the sidewall fairing 26FS with the curved surface 26WS, and a lower boundary 26LB of the sidewall fairing 26FS, again as defined with the hull 16H in the upright position, is defined by the intersection of the sidewall fairing 26FS with a correspond port or the starboard bottom hull surface 16P or 16S, with the forward extremity 26SE of the sidewall fairing 26FS being formed by the converging intersection of the upper boundary 26UB and the lower boundary 26LB at the corresponding one of the port or the starboard hull surface 16P or 16S. The aft edge 26AS of each sidewall fairing 26FS is generally vertical and is defined by the line of intersection between the sidewall fairing 26FS and the generally vertical inside boundary 24I of the corresponding one of pod drive platforms 24A and 24B at the forward edge of the pod drive platform 24A or 24B.

Each generally horizontal curved surface 26WS is defined by an inner boundary 26IB extending along an intersection of the curved surface 26WS with the sidewall fairing 26FS, and an aft boundary 26AB extending along the intersection between the curved surface 26WS and the forward edge of the corresponding pod drive platform 24 from the intersection of the sidewall fairing 26FS with the curved surface 26WS to an intersection between outer boundary 24O of the pod drive platform 24 and the corresponding port and starboard hull surface 16P or 16S, at the forward edge of the pod drive platform 24. An outer boundary 26OB of the curved surface 26WS extends forward, from the aft boundary 26AB, and is generally a continuation of the outer boundary 24O of the pod drive platform 24, along the port or the starboard hull surface 16P or 16S, to a forward boundary 26FB of the curved surface 26WS. The forward boundary 26FB of the curved surface 26WS then extends across the hull 16H, generally transversely or normal to the keel 16K along the port or the starboard hull surface 16P or 16S, to the forward extremity 26SE of the sidewall fairing 26FS and to the intersection of the forward boundary 26FB of the curved surface 26WS with the outer boundary 26OB of the curved surface 26WS.

In a presently preferred embodiment of the curved hull configuration 30, the aft portion of each curved surface 26WS is curved to tangentially intersect the forward edge of each pod drive platform 24 and the forward portion of each curved surface 26WS is curved to tangentially intersect the port or the starboard hull surface 16P or 16S along the forward boundary 26FB of the curved surface 26WS to thereby provide a smooth exterior surface for a water flow path along the exterior surface of the hull 16 between the port or the starboard hull surface 16P or 16S and the curved surface 26WS.

It will be noted from the above description and from FIGS. 12A and 13A-13G, that a curved hull configuration 30 does not include any form of "tunnel" or "channel", thus avoiding the problems and disadvantages associated with tunnels and channels in the hull configurations of the prior art.

Construction of Pod Drive Platforms and Hull Configurations

Lastly, and in brief, it will be understood that the above described pod drive platform installations and hull configurations may be achieved by both modification of an existing hull and by construction in a new boat hull. It will be well understood by those of ordinary skill in the arts that the modification of an existing hull involves excising those portions of an existing hull, hull structures, and drive mechanisms not conforming to the desired pod drive system pod platforms, pod drive units and hull configuration and construction of the desired pod drive system pod platforms, pod drive units and hull configuration onto the remaining structural elements of the original hull. The installation of the desired pod drive system pod platforms, pod drive units and hull configuration into a new hull as it is being designed and built, however, follows the conventional processes for designing and constructing hulls and propulsion systems.

It will be apparent from the above description that the pod drive installation 10 and the pod drive platform 24, according to the present invention, require significantly fewer and less extreme modifications to the hull of the vessel, require significantly less space in the stern of a vessel, and cause significantly less disturbance to the exterior contours of the vessel and thus the fluid flow characteristics of the undersurface of the hull than do the tunnel pod drive systems of the prior art. As a result, the pod drive installation 10 and the pod drive platform 24, according to the present invention, have significantly less negative effects on buoyancy in the stern regions of the vessel and on the distribution of buoyance and trim of the vessel than do a tunnel drive systems of the prior art, have less effects on the planing characteristics of the vessel than do the tunnel drive systems of the prior art, and significantly reduce or eliminate the "squatting" or "sinking" effects resulting from the use of tunnels to mount the pod drive units. In addition, the pod drive installation 10 and the pod drive platform 24, of the present invention, do not materially or significantly increase the "wetted surface area" of the hull, as is common with the tunnel drive systems of the prior art, and thus do not materially increase the frictional drag of the hull. The pod drive installation 10 and the pod drive platform 24, of the present invention, also significantly reduce or eliminate the channeling of the water flow around the propellers, generally caused by tunnel drive systems, and correspondingly reduce or eliminate the consequent generation of low pressure regions at the stern and resultant adverse effects on vessel trim angles.

Lastly, it must be noted that because the pod drive installation 10 and the pod drive platform 24, according to the present invention, allows the steering axes 2L to be vertical oriented, the pod drive installation 10 and the pod drive platform 24 of the present invention generally eliminate the rolling effect resulting from the use of slanted steering axes, such as are common in slanted steering axis drive systems of the prior art.

In conclusion, while the present invention is particularly shown and described with reference to presently preferred embodiments of the apparatus and methods thereof, it will be also understood by those of ordinary skill in the art that various changes, variations and modifications in form, detail(s) and implementation(s), may be made therein without departing from the spirit and scope of the invention as defined by the appended claims.

What is claimed is:

1. A pod drive installation for mounting a pod drive unit to a hull of a vessel having a keel, the pod drive installation comprising:

a horizontally disposed planar pod drive platform for supporting a rotational pod drive mount for mounting the pod drive unit so that the pod drive unit has a generally vertically oriented steering axis, the pod drive platform having a width, extending generally perpendicular to the keel that is either equal to or greater than a width dimension of the rotational pod drive mount, and having a length, extending generally parallel to the keel, that is either equal to or greater than a length dimension of the rotational pod drive mount, being mounted to the hull, spaced outward from the keel, so that a plane defined by a bottom hull surface tilted from the horizontal intersecting the pod drive platform along a contour of intersection, between an outboard boundary of the pod drive platform and an inboard boundary of the pod drive platform, and being connected to the bottom hull surface by at least one of an outboard sidewall and an inboard sidewall.

2. The pod drive installation according to claim 1, wherein:

the pod drive platform, the bottom hull surface and the at least one of an outboard sidewall and an inboard sidewall form a corresponding at least one of an outboard protrusion, from the bottom hull surface, and an inward recess, into the bottom hull surface.

3. The pod drive installation according to claim 1, wherein:

the at least one of the inboard and the outboard sidewalls forms a fairing between the pod drive platform and the bottom hull surface.

4. The pod drive installation according to claim 3, wherein:

the length of pod drive platform and of the at least one of the inboard and output sidewalls extend parallel to the keel and are greater than the width of the pod drive platform.

5. The pod drive installation according to claim 1, wherein the pod drive unit comprises:

an inboard propulsion device for driving an inboard transmission unit which drives an underwater steerable gearcase, the steerable gearcase is rotatably mounted through the hull, by the rotational pod drive mount, so as to rotate about the steering axis and drive a propeller.

6. The pod drive installation according to claim 1, wherein:

the hull of the vessel is one of a V-shaped hull and a hull having a curved shape.

7. A dual pod drive installation for mounting at least a port pod drive unit and a starboard pod drive unit to a hull of a vessel having a keel, the dual pod drive installation comprising:

a horizontally disposed planar port pod drive platform and a horizontally disposed planar starboard pod drive platform, each for supporting a respective rotational pod drive mount for mounting one of a port pod drive unit and a starboard pod drive unit such that each of the port pod drive unit and the starboard pod drive unit have a generally vertically oriented steering axis, each pod drive platform having a width, extending generally perpendicular to the keel, and having a length, extending generally parallel to the keel, that are either equal to or greater than respective width and length dimensions of the respective rotational pod drive mount, being mounted to the hull radially outward of the keel so that a plane defined by a bottom hull surface tilted from the horizontal intersecting the pod drive platform along a contour of intersection between an outboard boundary of the pod drive platform and an inboard boundary of the pod drive platform, and being connected to the bottom hull surface by at least one of an outboard sidewall and an inboard sidewall.

8. A pod drive installation and hull configuration for mounting at least a port pod drive unit and a starboard drive unit to a hull of a vessel having a keel, the pod drive installation and hull configuration comprising:

at least one horizontal pod drive platform for supporting at least one rotational pod drive mount for mounting at least one pod drive unit symmetrically with respect to the keel, each pod drive platform having a width and a length that are either equal to or greater than a respective width and length dimension of a corresponding rotational pod drive mount, and a triangular hull configuration including a pod drive mounting plane extending on either side of the keel of the hull and supporting the at least one pod drive platform, a triangular fairing connecting the pod drive platform to a corresponding bottom hull surface, the triangular fairing including a generally triangular fairing extending forward and downward, from a fairing inflection line at a forward end of pod drive mounting plane and to a triangular fairing intersection point with the keel, the triangular fairing having doubly curved surface having a concave transversely extending arc toward an aft section of the triangular fairing and a convex transversely extending arc toward a front section of the triangular fairing with the triangular fairing being tangent with the plane of the pod drive mounting plane at the fairing inflection line and with a plane of the keel at the triangular fairing intersection point, whereby, the pod drive mounting plane and the triangular fairing together have outer boundary contours formed by an intersection of the pod drive mounting plane and the triangular fairing with the bottom hull surfaces.

9. The pod drive installation and hull configuration of claim 8, wherein the at least one pod drive platform comprises:

both a port horizontally disposed pod drive platform and a starboard horizontally disposed pod drive platform for each supporting a respective pod drive mount for mounting a respective pod drive unit, each pod drive platform having a width and a length that are respectively either equal to or greater than a width and a length of the respective pod drive mount and being mounted to the hull, outward of the keel, so that each pod drive platform intersects a bottom hull surface along a contour of intersection between an outboard boundary of the pod drive platform and the bottom hull surface.

10. The pod drive installation and hull configuration of claim 8, wherein:

a forward and downward slant angle of the triangular fairing, with respect to the keel, forms and angle of about 7 degrees +4 degrees.

11. The pod drive installation and hull configuration of claim 9, further comprising:

a volume/planing structure axially centered along the keel, the volume/planing structure has a width, extending across the pod drive mounting plane between inside boundaries of the port and the starboard pod drive platforms and a length extending generally from an aft end of the port and the starboard pod drive platforms to the triangular fairing, at a location between the fairing inflection line and the triangular fairing intersection point with the keel, and the volume/planing structure has a height, relative to the pod drive mounting plane, that is equal to or less than a projected height of the keel with respect to the pod drive mounting plane.

12. A pod drive installation and hull configuration for mounting at least a port pod drive unit and a starboard drive unit to a hull of a vessel having a keel, the pod drive installation and hull configuration comprising:

a horizontally disposed port pod drive platform and a horizontally disposed starboard pod drive platform for each supporting a respective rotational pod drive mount for mounting a respective drive unit thereto, each pod drive platform that supports the corresponding rotational pod drive mount is mounted to the hull outward of the keel of the vessel, and a curved hull configuration having a port curved fairing that corresponds with the port pod drive platform and a starboard curved fairing that corresponds with the starboard pod drive platform for fairing of each respective pod drive platform with a corresponding portion of a bottom hull surface, each of the port and the starboard curved fairings including:

a generally vertical sidewall fairing and a generally horizontal curved fairing surface, each sidewall fairing having an upper boundary defined by an intersection of the sidewall fairing with the curved fairing surface, a lower boundary defined by an intersection of the sidewall fairing with the bottom hull surface, a forward extremity formed by a converging intersection of the upper boundary and the lower boundary at the bottom hull surface, and an aft boundary defined by a line of intersection between the sidewall fairing and an inside boundary of the corresponding one of the pod drive platforms at a forward edge of the corresponding pod drive platform, each generally horizontal curved fairing surface having an inner boundary extending along an intersection of the curved fairing surface and the upper boundary of the sidewall fairing, an aft boundary extending along an intersection between the curved fairing surface and the forward edge of the corresponding pod drive platform, an outer boundary extending forward from and in continuation of an outer boundary of the pod drive platform and along the bottom hull surface to a forward boundary of the curved fairing surface, the forward boundary of the curved fairing surface extending transversely from the forward extremity of the sidewall fairing and along the bottom hull surface to the outer boundary of the curved fairing surface.

13. The pod drive installation and hull configuration of claim 12, wherein:

an aft portion of each of the curved fairing surfaces is curved to tangentially intersect the forward edge of the corresponding pod drive platform and the aft boundary and a forward portion of each of the curved fairing surfaces is curved to tangentially intersect the bottom hull surface along the forward boundary of the curved fairing surface.

* * * * *